US012798812B2

(12) United States Patent
Myers et al.

(10) Patent No.: US 12,798,812 B2
(45) Date of Patent: Nov. 17, 2026

(54) APPARATUS FOR BOXING ROLL PACKED MATTRESS

(71) Applicant: Leggett & Platt, Incorporated, South Gate, CA (US)

(72) Inventors: Terrance L. Myers, Joplin, MO (US); Matthew C. Smallwood, Webb City, MO (US); James C. Kastler, Davie, FL (US); Michael A. James, Davie, FL (US)

(73) Assignee: L&P Property Management Company, Carthage, MO (US)

( * ) Notice: Subject to any disclaimer, the term of this patent is extended or adjusted under 35 U.S.C. 154(b) by 0 days.

(21) Appl. No.: 19/345,212

(22) Filed: Sep. 30, 2025

(65) Prior Publication Data

US 2026/0028145 A1 Jan. 29, 2026

Related U.S. Application Data

(63) Continuation of application No. 18/393,896, filed on Dec. 22, 2023, now Pat. No. 12,565,349.

(51) Int. Cl.

| | |
|---|---|
| ***B65B 43/26*** | (2006.01) |
| ***B65B 5/04*** | (2006.01) |
| ***B65B 7/20*** | (2006.01) |
| ***B65B 43/18*** | (2006.01) |
| ***B65B 43/30*** | (2006.01) |
| ***B65B 43/42*** | (2006.01) |

(Continued)

(52) U.S. Cl.

CPC ..... *B65B 43/265* (2013.01); *B65B 5/04* (2013.01); *B65B 7/20* (2013.01); *B65B 43/18* (2013.01); *B65B 43/30* (2013.01); *B65B 43/42* (2013.01); *B65B 51/067* (2013.01); *B65B 57/00* (2013.01); *B65B 59/00* (2013.01); *B65B 61/20* (2013.01); *B65B 61/28* (2013.01); *B65B 2220/14* (2013.01)

(58) Field of Classification Search

CPC . B65B 2210/04; B65B 2220/14; B65B 25/00; B65B 43/18; B65B 43/265; B65B 43/30; B65B 43/305; B65B 43/42; B65B 43/46; B65B 5/04; B65B 51/067; B65B 57/00; B65B 59/00; B65B 61/20; B65B 61/28; B65B 7/20

See application file for complete search history.

(56) References Cited

U.S. PATENT DOCUMENTS 6,764,436 B1 * 7/2004 Mazurek ..... B31B 50/804 493/122
8,046,973 B2 * 11/2011 Petrolati ..... B65B 59/001 53/118

(Continued)

FOREIGN PATENT DOCUMENTS

EP 3741691 A1 11/2020
WO WO-2019046892 A1 * 3/2019 ..... B65B 63/028

*Primary Examiner* — Himchan Song
(74) *Attorney, Agent, or Firm* — Wood Herron & Evans LLP

(57) ABSTRACT

An apparatus is provided for carrying out a method of erecting a flattened box, taping one end shut, inserted a roll packed mattress and taping the other end to complete the process. A controller controls the operation of the mostly automated process. An operator inputs certain parameters to control the process. Different size boxes and corresponding different size roll packed mattresses may be packaged on the same apparatus.

20 Claims, 39 Drawing Sheets

(51) Int. Cl.

| | |
|---|---|
| ***B65B 51/06*** | (2006.01) |
| ***B65B 57/00*** | (2006.01) |
| ***B65B 59/00*** | (2006.01) |
| ***B65B 61/20*** | (2006.01) |
| ***B65B 61/28*** | (2006.01) |

(56) References Cited

U.S. PATENT DOCUMENTS

| | | | | |
|---|---|---|---|---|
| 2008/0141632 | A1* | 6/2008 | Monti | B65B 5/024 53/566 |
| 2009/0239726 | A1* | 9/2009 | Huang | B31B 50/787 493/309 |
| 2015/0324893 | A1* | 11/2015 | Langen | B65B 43/145 705/26.81 |
| 2018/0126683 | A1* | 5/2018 | Johnson | B31B 50/046 |
| 2021/0114756 | A1* | 4/2021 | Fettner | B65B 39/06 |
| 2021/0237385 | A1* | 8/2021 | Fridolfsson | B65B 43/325 |
| 2022/0048658 | A1* | 2/2022 | Langen | B65B 43/145 |

* cited by examiner

APPARATUS FOR BOXING ROLL PACKED MATTRESS

CROSS REFERENCE TO RELATED APPLICATIONS

This application is a continuation of U.S. patent application Ser. No. 18/393,896, which is fully incorporated herein.

FIELD OF THE INVENTION

The present invention relates to machines for erecting boxes, and more particularly to an apparatus for erecting and taping a box for shipping a roll packed product such as a mattress.

BACKGROUND OF THE INVENTION

Several known machines are currently being sold for roll packing mattresses including the machine disclosed in U.S. Pat. No. 8,046,973. With an increase in ecommerce, more mattresses are being sold through the internet and being roll packed for shipment.

However, each roll packed mattress must be manually inserted into a custom sized box adapted to ship the roll packed mattress. Currently, these custom sized boxes must be erected and taped manually which takes time and money to pay for the labor. Labor may be difficult to find and expensive if one is lucky enough to obtain the requisite labor.

Thus, there is a need for an apparatus which reduces the labor required to box roll packed mattresses.

There is further a need for an apparatus which replaces the time consuming and labor-intensive process of manually constructing boxes for inserting roll packed mattresses.

There is further a need for uniformity in the construction of boxes for shipping roll packed products such as mattresses.

SUMMARY OF THE INVENTION

One aspect of the present invention is a method of erecting a cardboard box, inserting a roll packed product into the erected box and taping the box closed on an apparatus. The roll packed product may be any mattress including springs, foam, plastics or any combination thereof. However, the apparatus of the present invention is not intended to be limited to constructing boxes for bedding products; any products may be inserted into the erected boxes.

A method of boxing a roll packed mattress for shipment comprises activating a picker actuator and moving the picker actuator above an uppermost flattened box of a stack of flattened boxes. The next step comprises picking up the uppermost flattened box with the picker actuator and transporting the flattened box to a transfer location. The picker actuator has suction cups which are actuated by a controller to pick up the uppermost flattened box with the picker actuator and transporting the flattened box to a transfer location. The next step comprises moving a transport actuator to the transfer location and activating suction cups of the transport actuator to grip a bottom surface of the flattened box. The next step comprises moving an erector actuator to a position adjacent to the transport actuator and activating suction cups of the erector actuator to grip a top surface of the flattened box. Another step comprises disengaging the picker actuator from the flattened box and returning the picker actuator to its home position.

The next step comprises moving the erector actuator while the transport actuator remains stationary to erect the flattened box into an erected box. The next step comprises pushing first and second box flaps closed of the erected box using at least one flap actuator. The next step comprises moving the erected box downstream using the erector and transport actuators simultaneously such that arms fold third and fourth flaps of the erected box closed outside the first and second box flaps to create a partially closed, untaped erected box. The next step comprises moving the partially closed, untaped erected box past a tape dispenser which tapes the third and fourth flaps of the untaped erected box together to a create a partially closed box. The next step comprises disengaging the transport actuator from the partially closed box and returning the transport actuator to its home position.

The next step comprises moving the partially closed box to a mattress loading station. At the mattress loading station placing a roll packed mattress into the partially closed box to create a loaded box having an open end. The next step comprises moving the loaded box to a vertical or standing position onto a weighing station using a lift table. At the weighing station, the loaded box is weighed to verify the correct roll packed mattress has been inserted into the partially closed box. An operator then manually closes flaps of the open end of the loaded box and applies a center tape seam to create a closed box. If the operator wishes to insert literature into the interior of the box, the operator may do so before taping the box closed. The operator then manually rotates the closed box and inserts the closed box into a side taping section.

At the side taping section, the method further comprises taping outer edge of the closed box at each end of the closed box to create a finished box. The finished box has H-shaped seams of tape at each end. Conveyor belts/conveyors transfer the finished box to an offloading table. The offloading table may move up and down to ease handling of the finished box.

The method may be described another way as follows. The method comprises using a picker actuator having a picker plate with suction cups to transport a flattened box to a transfer location. The picker actuator moves the picker plate vertically and/or horizontally. The next step comprises moving a transport plate of a transport actuator underneath the flattened box at the transfer location. The next step comprises activating suction cups of the transport actuator to grip a bottom surface of the flattened box. The next step comprises moving an erector plate of an erector actuator to a position adjacent to the picker plate above the flattened box and activating suction cups of the erector actuator to grip a top surface of the flattened box. The next step comprises disengaging the picker actuator from the flattened box and returning the picker actuator to its home position.

The next step comprises raising the erector plate of the erector actuator while the transport actuator remains stationary to erect the flattened box into an erected box. The next step comprises folding closed vertical box flaps closed of the erected box. The next step comprises moving the erected box downstream past stationary arms to fold top and bottom flaps of the erected box outside the closed vertical box flaps to create a partially closed, untaped erected box. The next step comprises moving the partially closed, untaped erected box further downstream past a tape dispenser to tape the top and bottom flaps of the untapped, erected box together to a create a partially closed box. The next step comprises disengaging the transport actuator from the partially closed box and returning the transport actuator to its home position. A controller controls movement of the actuators.

The next step comprises moving the partially closed box to a mattress loading station. At the mattress loading station, a roll packed mattress is inserted into the partially closed box to create a loaded box having an open end. The next step comprises activating a lift table to lift the loaded box to a standing position. The next step comprises an operator manually closing all four flaps of the open end of the loaded box and applying a center tape seam to create a closed box. The operator then manually rotates the closed box and inserts the closed box into a side taping section.

At the side taping section, the method further comprises taping outer edge of the closed box at each end of the closed box to create a finished box. Conveyor belts/conveyors transfer the closed box to an offloading table. The offloading table moves up and down to ease handling of the finished box.

The method may be described another way as follows. The method comprises at a first section transporting a flattened box to a transfer location using a picker actuator having suction cups. The next step comprises moving a transport plate of a transport actuator underneath the flattened box at the transfer location. The next step comprises activating suction cups of the transport actuator to grip a bottom surface of the flattened box. The next step comprises moving an erector plate of an erector actuator to a position adjacent to the picker plate above the flattened box and activating suction cups of the erector actuator to grip a top surface of the flattened box. The next step comprises disengaging the picker actuator from the flattened box and returning the picker actuator to its home position.

The next step comprises raising the erector plate of the erector actuator while the transport actuator remains stationary to erect the flattened box into an erected box. The next step comprises folding closed vertical box flaps closed of the erected box. The next step comprises moving the erected box downstream past stationary arms to fold top and bottom flaps of the erected box outside the closed vertical box flaps to create a partially closed, untaped erected box. The next step comprises moving the partially closed, untaped erected box further downstream past a tape dispenser to tape the top and bottom flaps of the untapped, erected box together to a create a partially closed box. The next step comprises disengaging the transport actuator from the partially closed box and returning the transport actuator to its home position.

The next step comprises moving the partially closed box to a second section. At the second section, a roll packed mattress is inserted into the partially closed box to create a loaded box having an open end. The next step comprises activating a lift table to lift the loaded box to a standing position. The next step comprises an operator manually closing all four flaps of the open end of the loaded box and applying a center tape seam to create a closed box. The operator then manually rotates the closed box and inserts the closed box into a third section.

At the third section, the method further comprises taping outer edges of the closed box at each end of the closed box to create a finished box 30. Conveyor belts transfer the closed box to an offloading table. The offloading table moves up and down to ease handling of the finished box.

By virtue of the foregoing, the automated method provides a way to quickly and easily box roll packed mattresses. Using the apparatus of the present invention, operators need not manually erect boxes. Furthermore, the operators need not lift and remove heavy roll packed mattresses into boxes to the extent required currently. The automatic handling of boxes of roll packed mattresses provides an ergonomic benefit and reduces downtime when the apparatus is not operating. The apparatus improves the efficiency of the boxing process. An additional advantage is that the correct boxes are used for matching roll packed mattresses.

These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, explain the principles of the present invention.

DETAILED DESCRIPTION OF THE DRAWINGS

Figure 1:
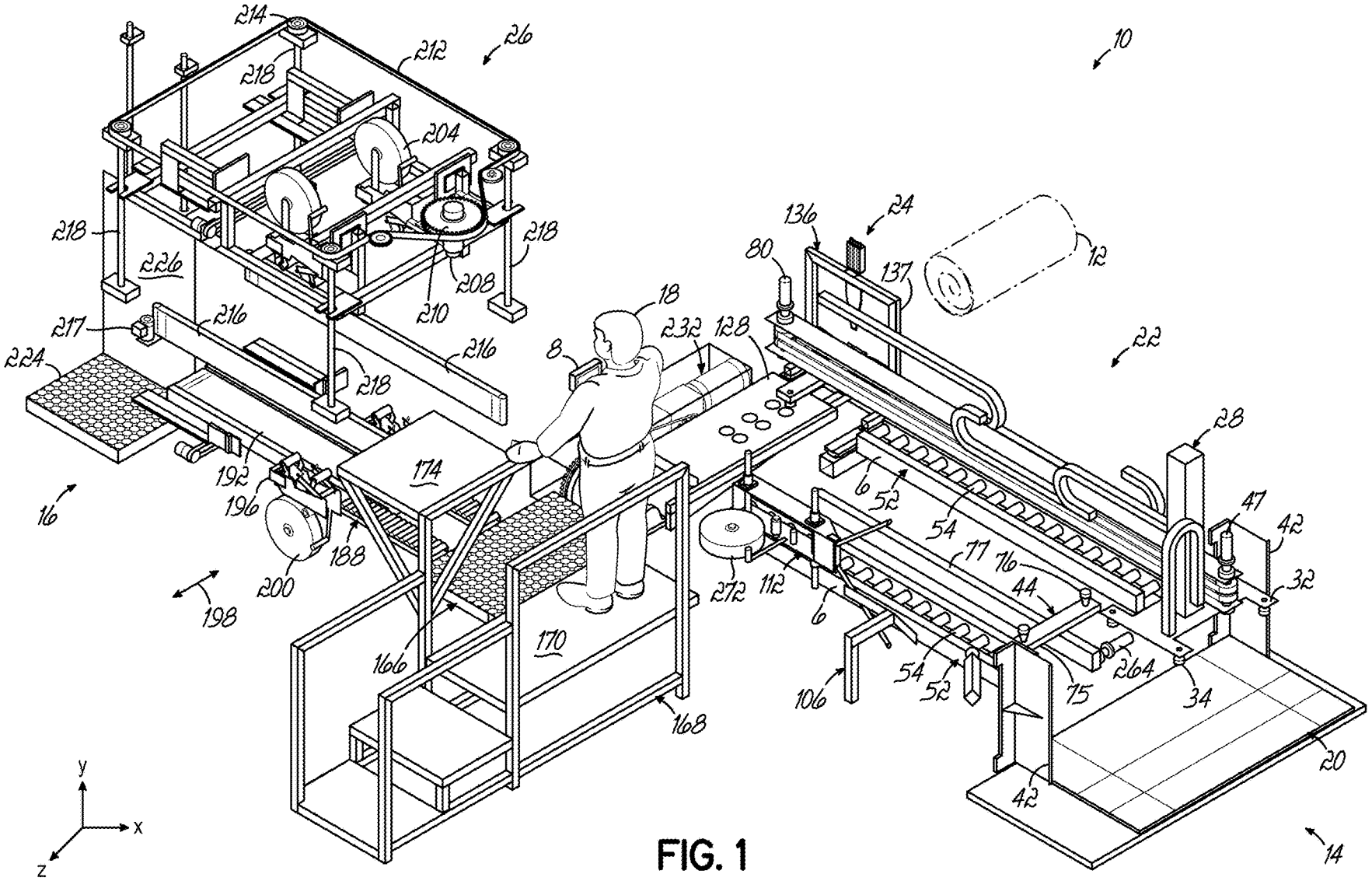
FIG. 1 is a front perspective view of an apparatus for erecting a box, inserting a roll packed mattress into the erected box and taping the box shut in accordance with the principles of the present invention.
Figure 25:
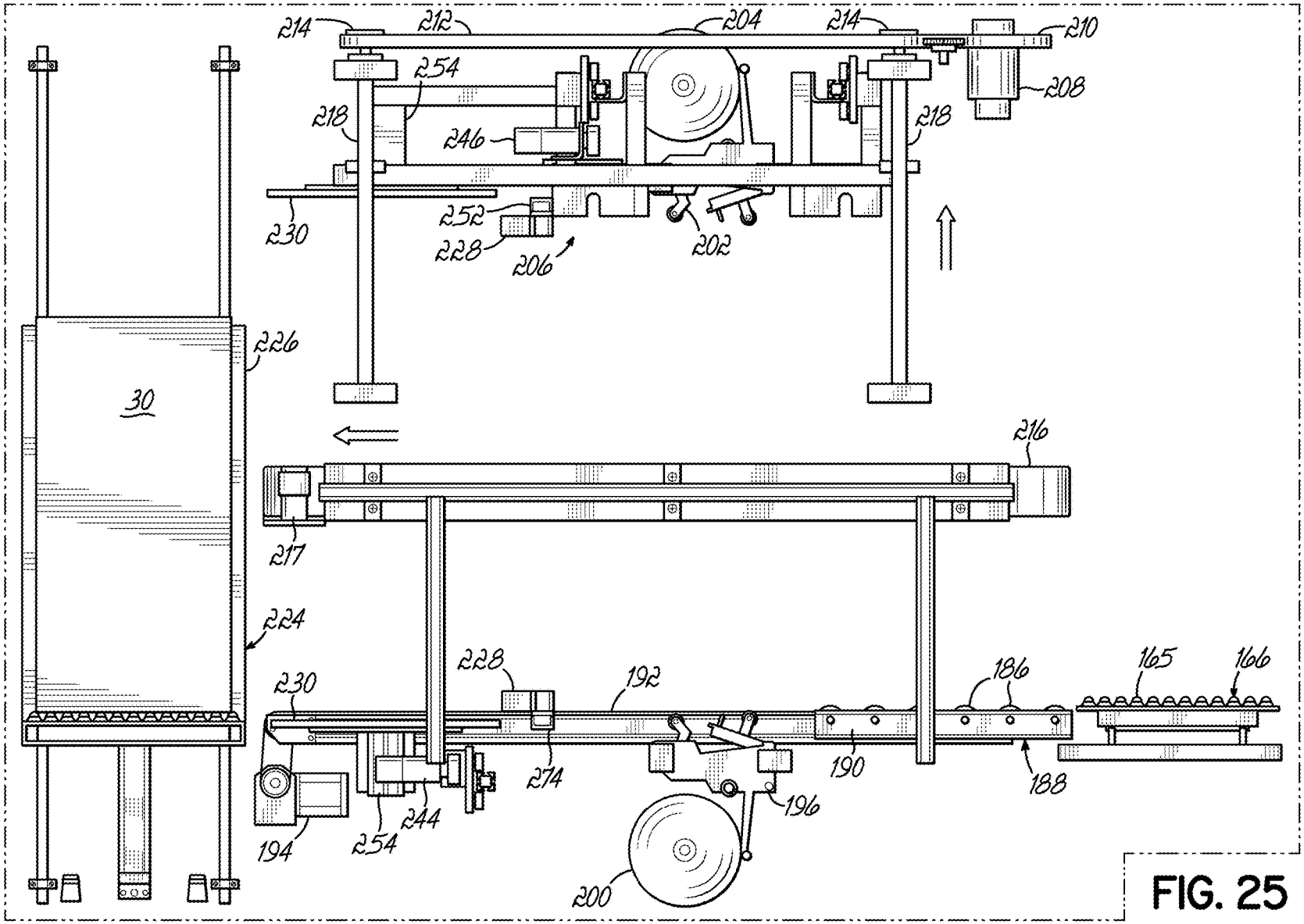
FIG. 25 is a side view of the third section of the apparatus showing the fully taped box being on an offloading table and the top tape assembly being raised to its resting position.
Figure 26:
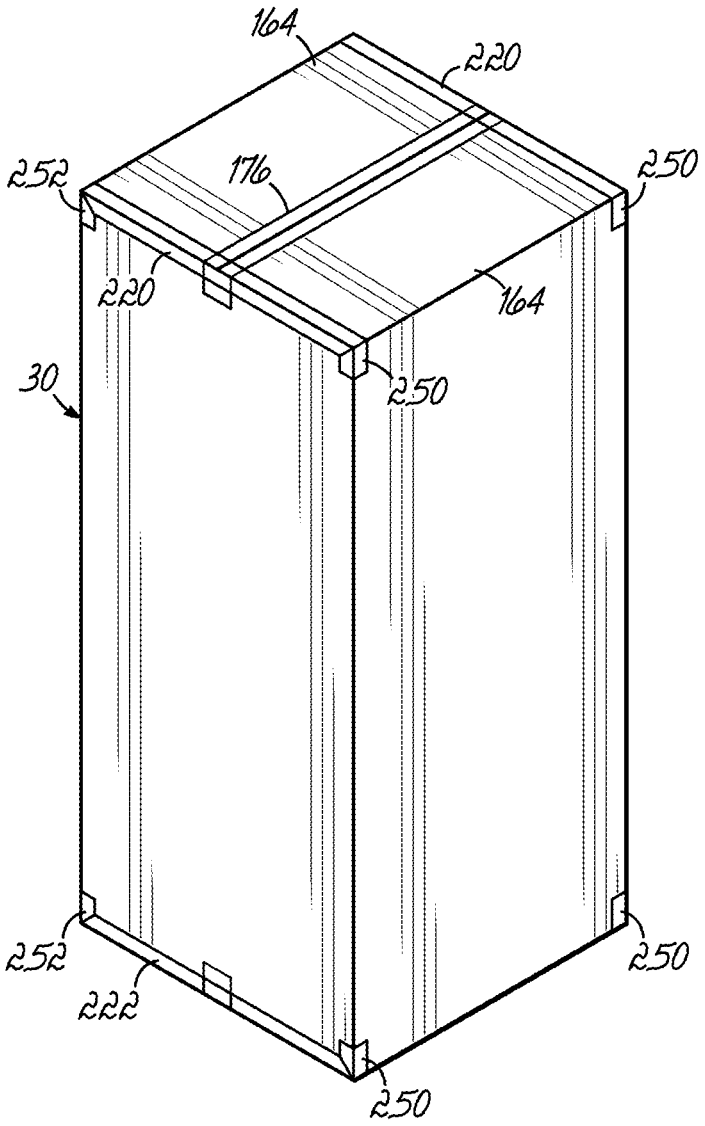
FIG. 26 is a front perspective view of the finished box.

With reference to FIG. 1, there is shown an apparatus 10 for boxing a roll packed mattress 12 (shown in dashed lines in FIGS. 16A-16E, 17 and 19) for shipment. For purposes of this document, the apparatus 10 has a front or upstream end 14 and a downstream end 16. The terms upstream and downstream refer to the flow of a box as the box passes through the apparatus 10 with the assistance of an operator 18. As shown in FIGS. 25 and 26, a finished box 30 containing a roll packed mattress 12 and fully taped is located at the downstream end 16 of the apparatus 10.

The apparatus 10 comprises a first or erecting section 22 for erecting a box from a flattened condition and a second or packing section 24 for inserting a roll packed mattress 12 into a partially closed box 21 to create a loaded box 158 and lifting the loaded box 158 onto a weighing station 166. The apparatus 10 further comprises a third or sealing section 26 for taping the loaded box 158 shut to create the finished box 30.

Figure 28:
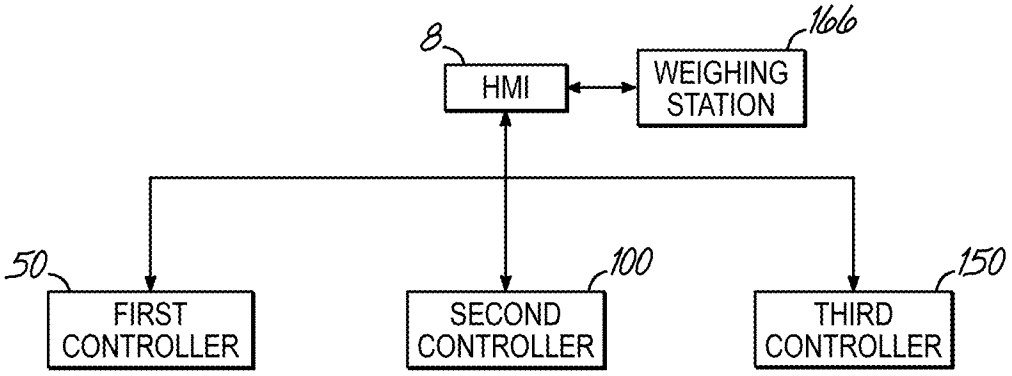
FIG. 28 is a flow chart showing what portions of the apparatus the human/machine interface controls.

As shown in FIG. 28, operation of the first section 22 of apparatus 10 is at least partially controlled by a first controller 50. Operation of the second section 24 of apparatus 10 is at least partially controlled by a second controller 100. Operation of the third section 26 is at least partially controlled by a third controller 150.

Figure 9:
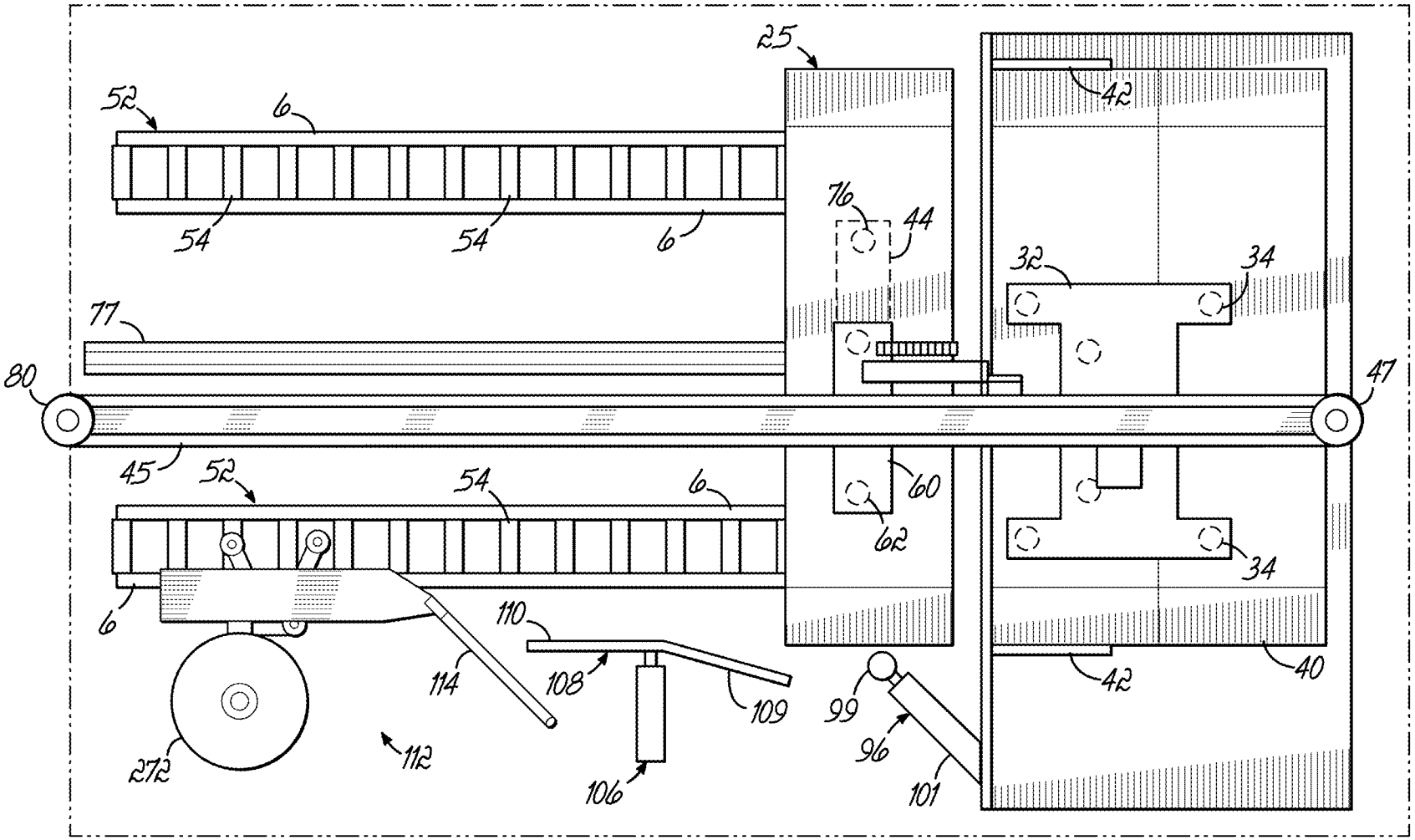
FIG. 9 is a top view of the first section of the apparatus of FIG. 1 with the actuators shown in their positions as shown in FIG. 8.

Referring to FIG. 1, the first section 22 of apparatus 10 comprises two spaced roller assemblies 52, each roller assembly 52 including two braces 6 and rotatable rollers 54. The roller assemblies 52 are spaced from each other and generally coplanar. As best shown in FIG. 9, each roller assembly 52 comprises two braces 6 to which the rollers 54 are rotatably mounted.

Figure 2:
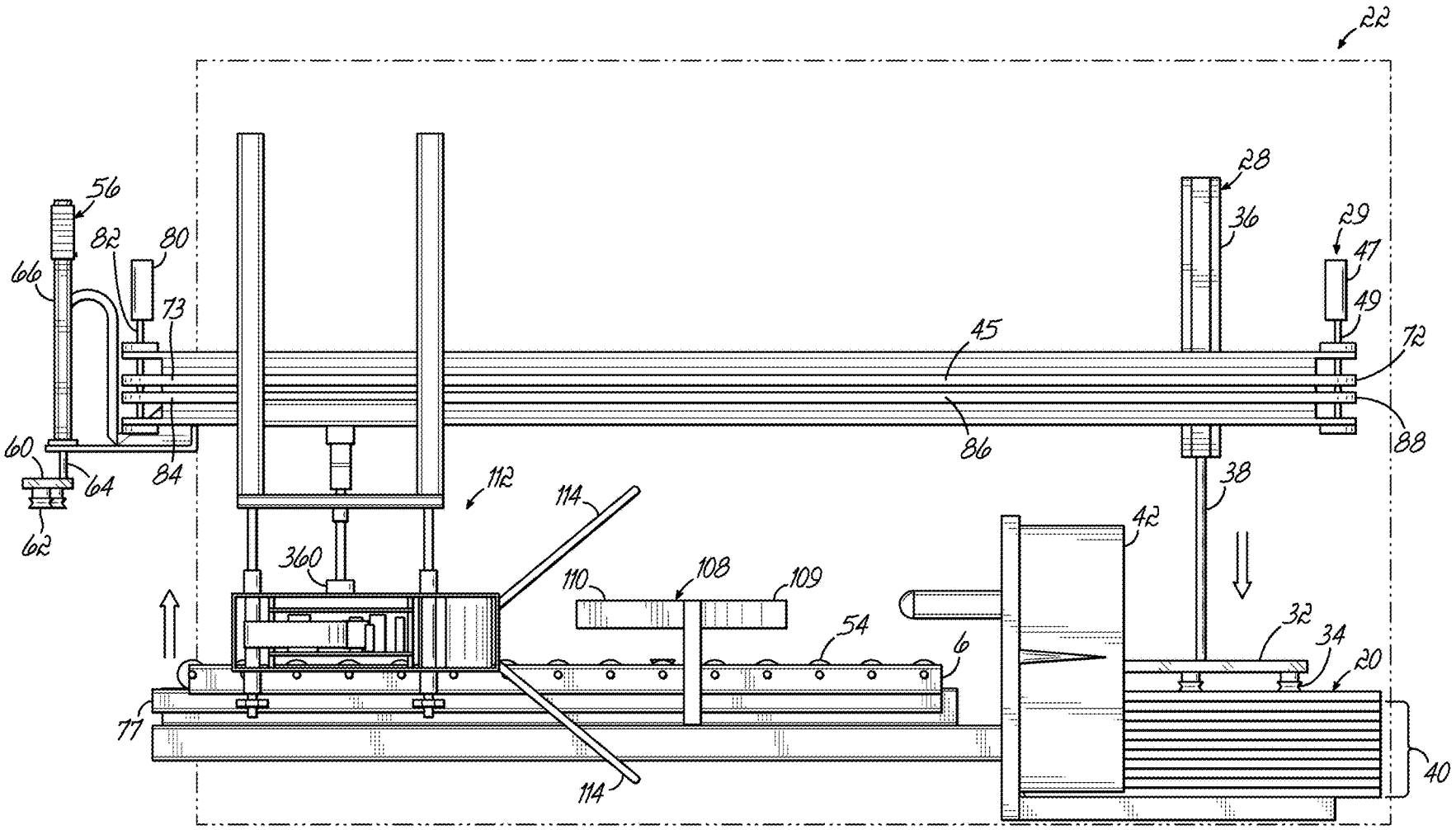
FIG. 2 is a side view of the first section of the apparatus of FIG. 1 showing the picker actuator being lowered to engage a stack of flattened boxes.

As shown in FIG. 2, at the first section 22, a picker plate 32 of a picker actuator 28 is shown being lowered from a raised position while the picker actuator 28 is in its home position. The picker actuator 28 moves the picker plate 32 in a vertical direction via the first controller 50 (see FIG. 26). The picker actuator 28 is movable horizontally between a home position shown in FIG. 8 and a downstream position shown in FIG. 5 via operation of the picker mover 29.

The picker actuator 28 comprises a picker plate 32 having picker suction cups 34 on the bottom surface thereof. The picker actuator 28 further comprises a picker cylinder 36 which raises and lowers a picker rod 38. The picker plate 32 is secured to the lower end of the picker rod 38. FIG. 2 shows the picker actuator 28 lowering the picker plate 32 until the picker suction cups 34 contact an uppermost flattened box 20 of a stack 40 of flattened boxes.

The picker suction cups 34 of the picker actuator 28 are activated by being supplied with air to grab the uppermost flattened box 20. The air is turned on and off via the first controller 50. Although the drawings show three picker suction cups 34 attached to the picker plate 32, any number of suction cups of any desired size may be used. For purposes of this document, the flattened uppermost box 20 will be described in detail as it moves through the apparatus 10, gets erected and filled before being taped shut to create the finished box 30.

Figure 3:
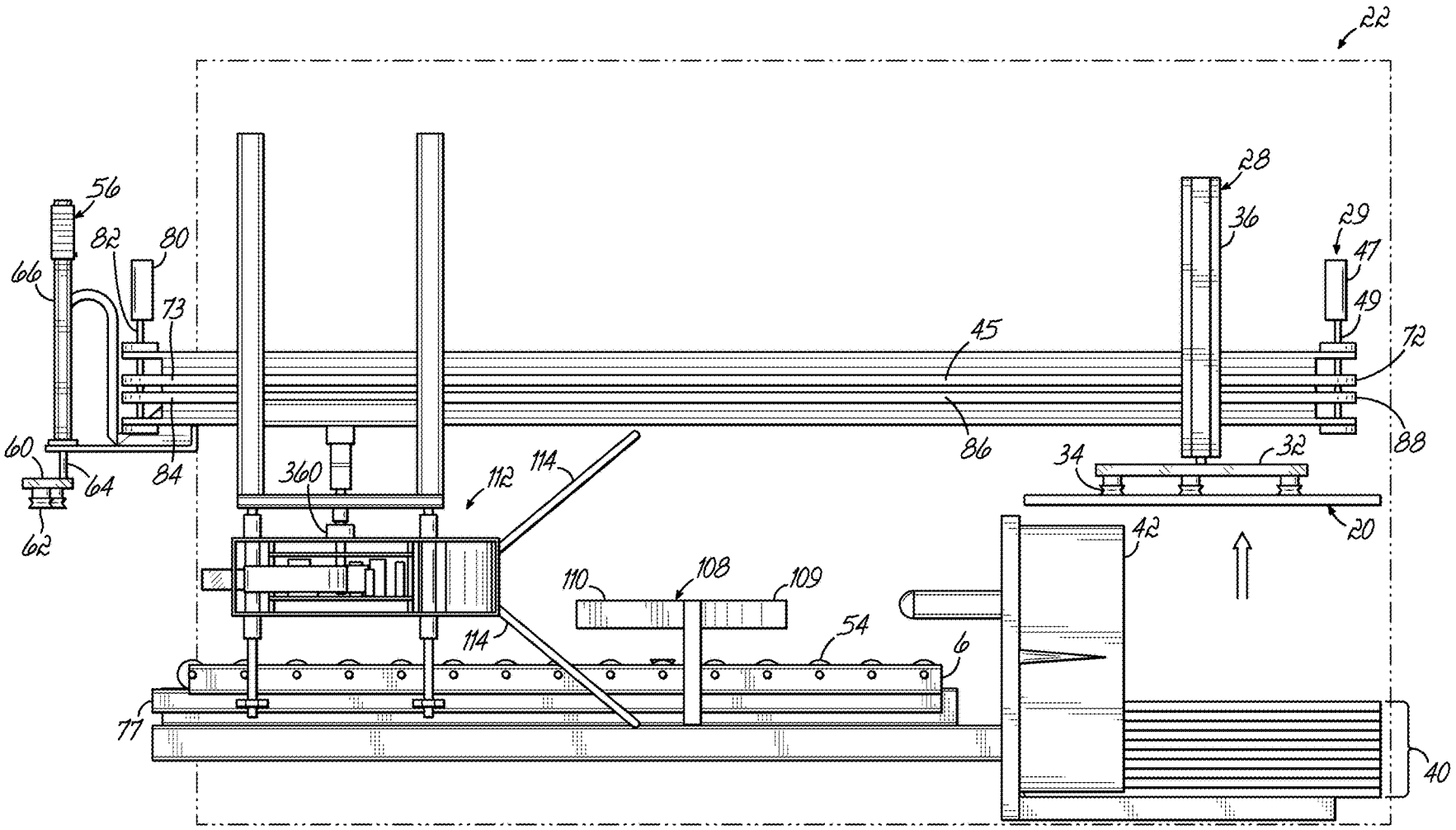
FIG. 3 is a side view of the first section of the apparatus of FIG. 1 showing the flattened box being lifted over front gates.

FIG. 3 shows the picker plate 32 raised to its raised position via the picker actuator 28 while the picker suction cups 34 engage the flattened box 20. The picker actuator 28 raises the flattened box 20 above front gates 42, as seen in FIG. 1. The front gates 42 function to hold the stack 40 of flattened boxes in its desired location. Although one configuration of front gate 42 is illustrated, the front gate(s) may assume any desired configuration or structure. The drawings are not intended to be limiting.

Figure 4:
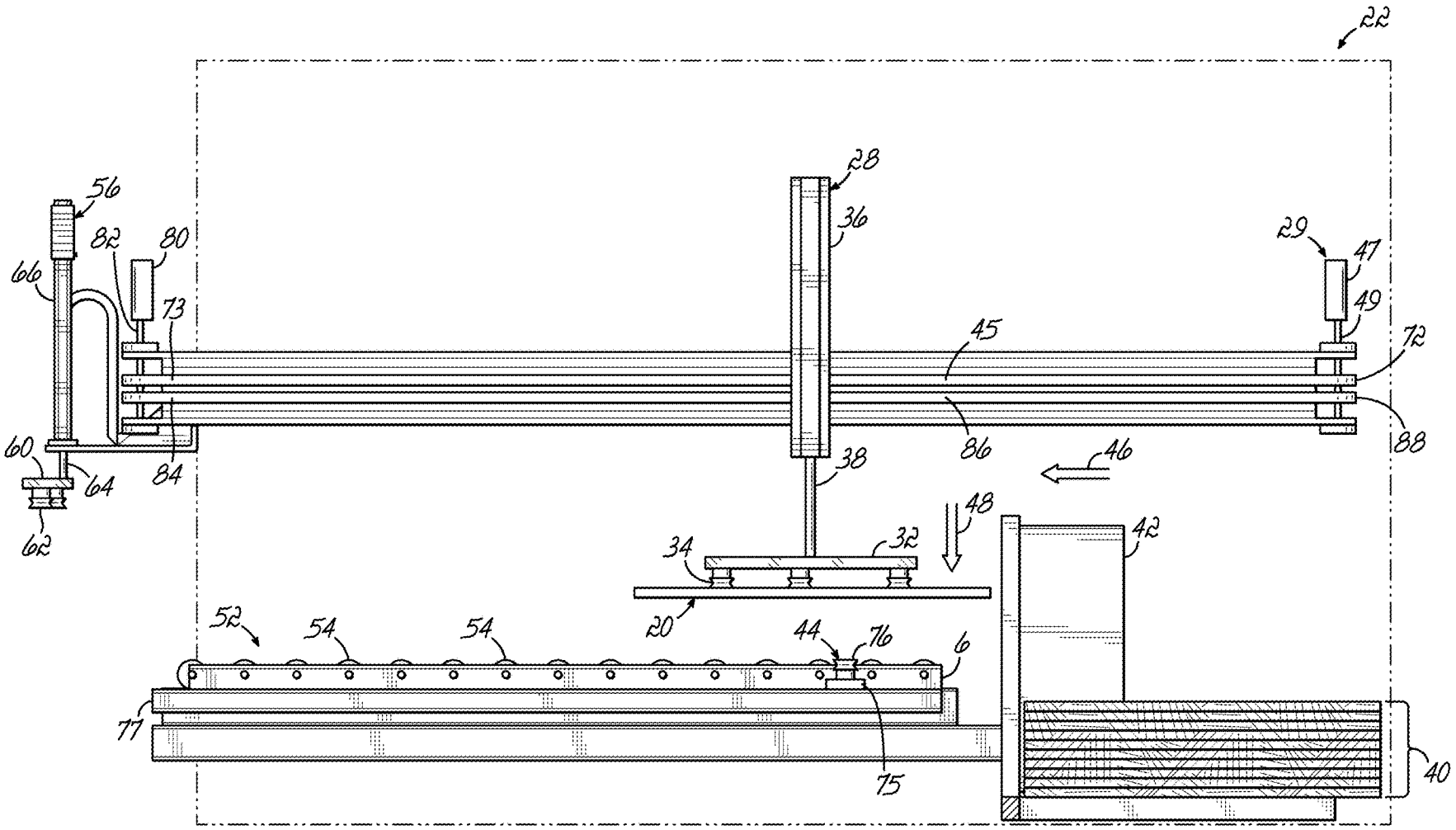
FIG. 4 is a cross-sectional view of a portion of the first section of the apparatus of FIG. 1 showing the picker actuator lowering flattened box after it has been moved downstream.
Figure 29:
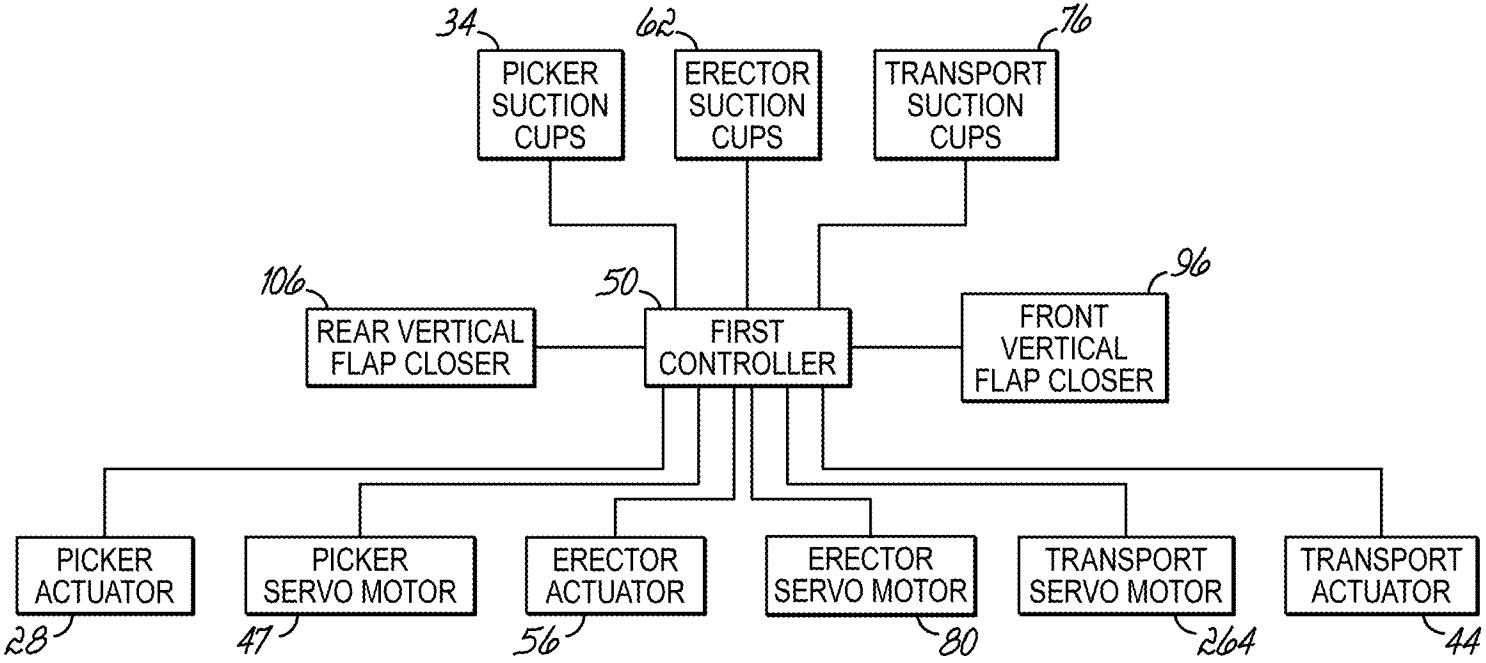
FIG. 29 is a flow chart further showing which parts of the first section of the apparatus are controlled by the first controller.

As best shown in FIGS. 3-8, the picker actuator 28 is moved horizontally by a picker mover 29 comprising a picker belt 45 driven by a picker servo motor 47. FIG. 4 shows the picker actuator 28 moved horizontally downstream by movement of the picker belt 45 driven by the picker servo motor 47, as indicated by arrow 46, to a transfer location. FIGS. 4-7 show the picker actuator at the transfer location. The transfer location is downstream of the gates 42 and above the roller assemblies 52. The picker servo motor 47 of picker mover 29 rotates a shaft 49 which rotates a drive pulley 72 around which the picker belt 45 passes. The picker belt 45 further passes around a driven pulley 73 which is mounted on shaft 82. Rotation of the picker belt 45 moves the picker actuator 28 horizontally because the picker actuator 28 is secured to the picker belt 45. The operation of the picker servo motor 47 is controlled by the first controller 50, as shown in FIG. 29.

Figure 5:
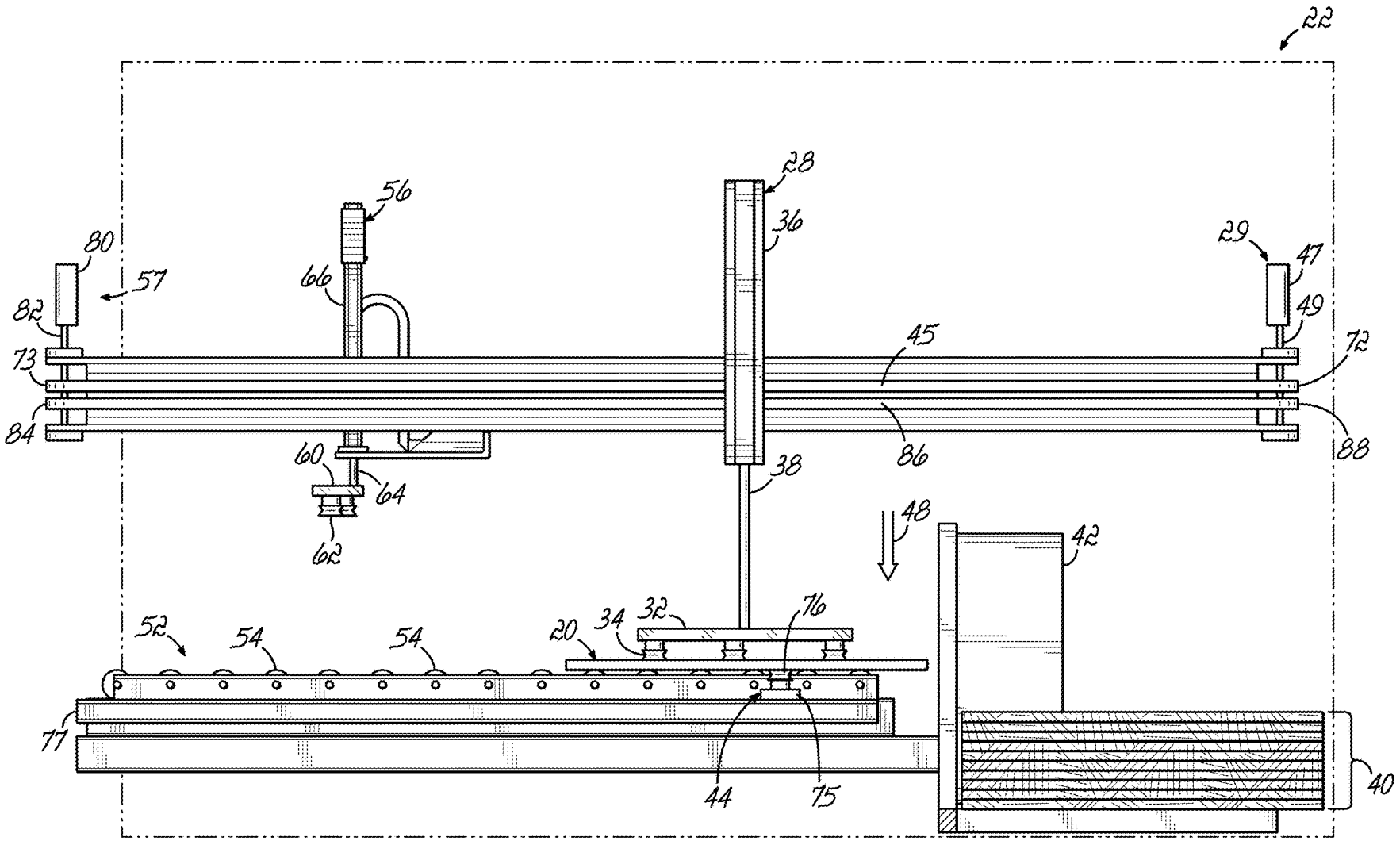
FIG. 5 is a cross-sectional view of the portion of the first section of the apparatus shown in FIG. 4 showing the picker actuator being engaged with the flattened box and the erector actuator being moved horizontally towards an erecting position.

At its downstream position, the picker actuator 28 is activated to lower the flattened box 20, as shown by the arrow 48 until the flattened box 20 rests upon the rollers 54. FIG. 5 shows the flattened box 20 supported by the rollers 54 at the transfer location.

As best shown in FIG. 1, a transport actuator 44 is located between the roller assemblies 52 and generally underneath the roller assemblies 52. The transport actuator 44 is driven by a transport servo motor 264, as best shown in FIGS. 1, 10A and 10B. The transport servo motor 264 is controlled by the first controller 50 as indicated in FIG. 29.

FIG. 4 shows the transport actuator 44 in its home position. Movement of the transport actuator 44 is controlled by the first controller 50. The transport actuator 44 includes a transport plate 75 and two transport suction cups 76 secured to the transport plate 75. The transport suction cups 76 extend upwardly from the transport plate 75, as best shown in FIG. 1. The transport plate 75 extends generally parallel the rollers 54. Although the transport actuator 44 is shown having two transport suction cups 76, it may include any number of transport suction cups. As best shown in FIG. 1, the transport actuator 44 further comprises a travel rail 77 which extends generally parallel the roller assemblies 52 or from front to back or longitudinally within the first section 22 of apparatus 10. As best shown in FIG. 1, the transport plate 75 of the transport actuator 44 extends perpendicular to the travel rail 77 and moves along the travel rail 77 upon activation of the transport actuator 44 by the transport servo motor 264.

When supplied with air via first controller 50, the transport suction cups 76 engage a lower surface of the flattened box 20 to hold the flattened box 20 in a transfer position shown in FIG. 5. The transport actuator 44 functions to move the box 20 downstream in the direction of the travel rail 77, as described below.

FIG. 5 shows the picker suction cups 34 of the picker actuator 28 engaged with an upper surface of the flattened box 20 and the transport suction cups 76 of the transport actuator 44 being engaged with the lower surface of the flattened box 20 while the flattened box 20 is supported by the rollers 54 of the roller assemblies 52.

Figure 5A:
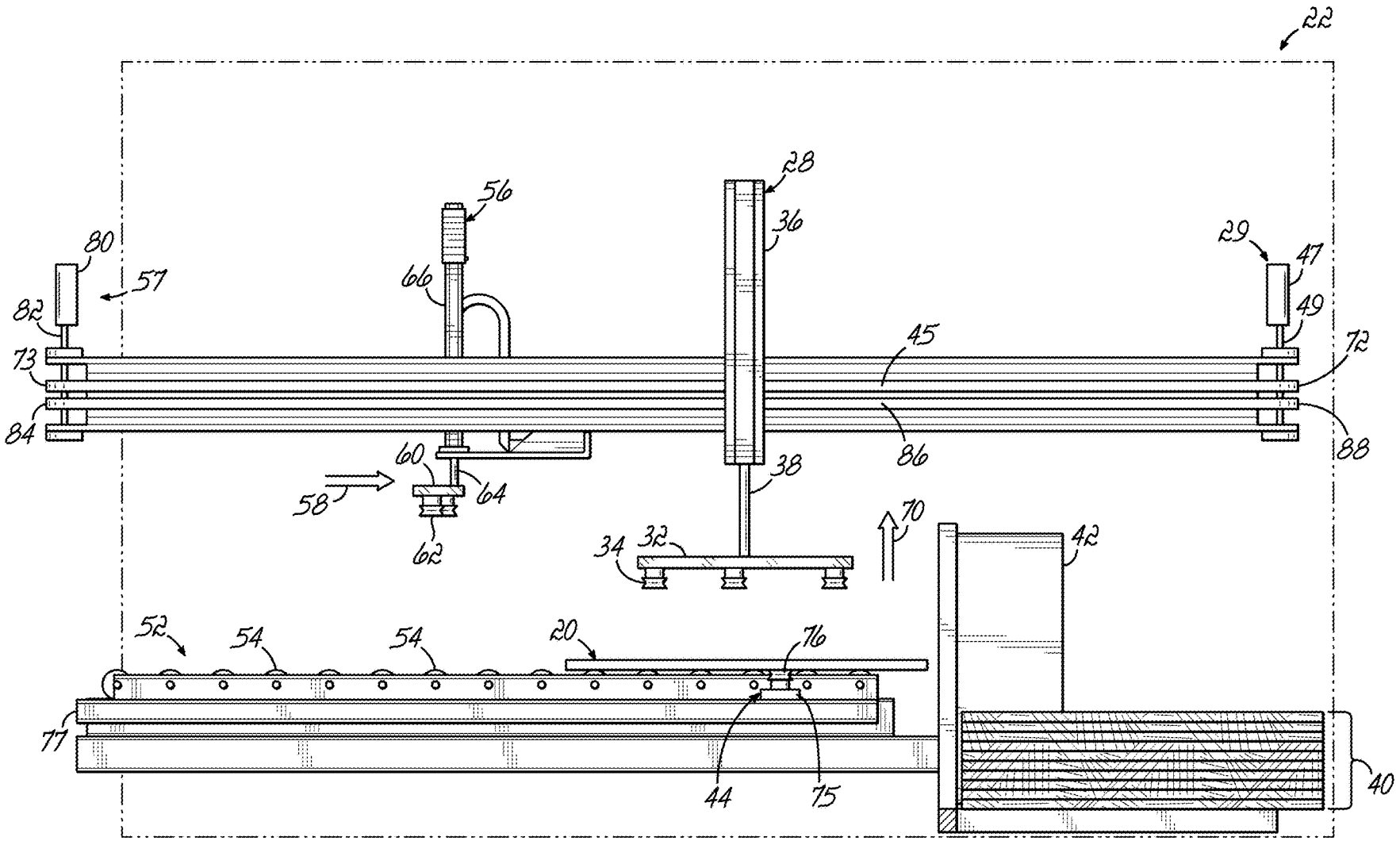
FIG. 5A is a cross-sectional view like FIG. 5 showing the picker actuator disengaged from the flattened box and the erector actuator being moved further towards its erecting position.

As shown in FIG. 5A, while the transport suction cups 76 of the transport actuator 44 are engaged with the lower surface of the flattened box 20, the first controller 50 turns off air flowing to the picker suction cups 34 to disengage the picker suction cups 34 from the upper surface of flattened box 20. The first controller 50 then actuates the picker cylinder 36 to raise the picker plate 32, as shown by arrow 70 in FIG. 5A. As shown in FIG. 5A, the arrow 70 shows the upward movement of the picker plate 32 and associated picker suction cups 34 to their raised position.

Figure 6:
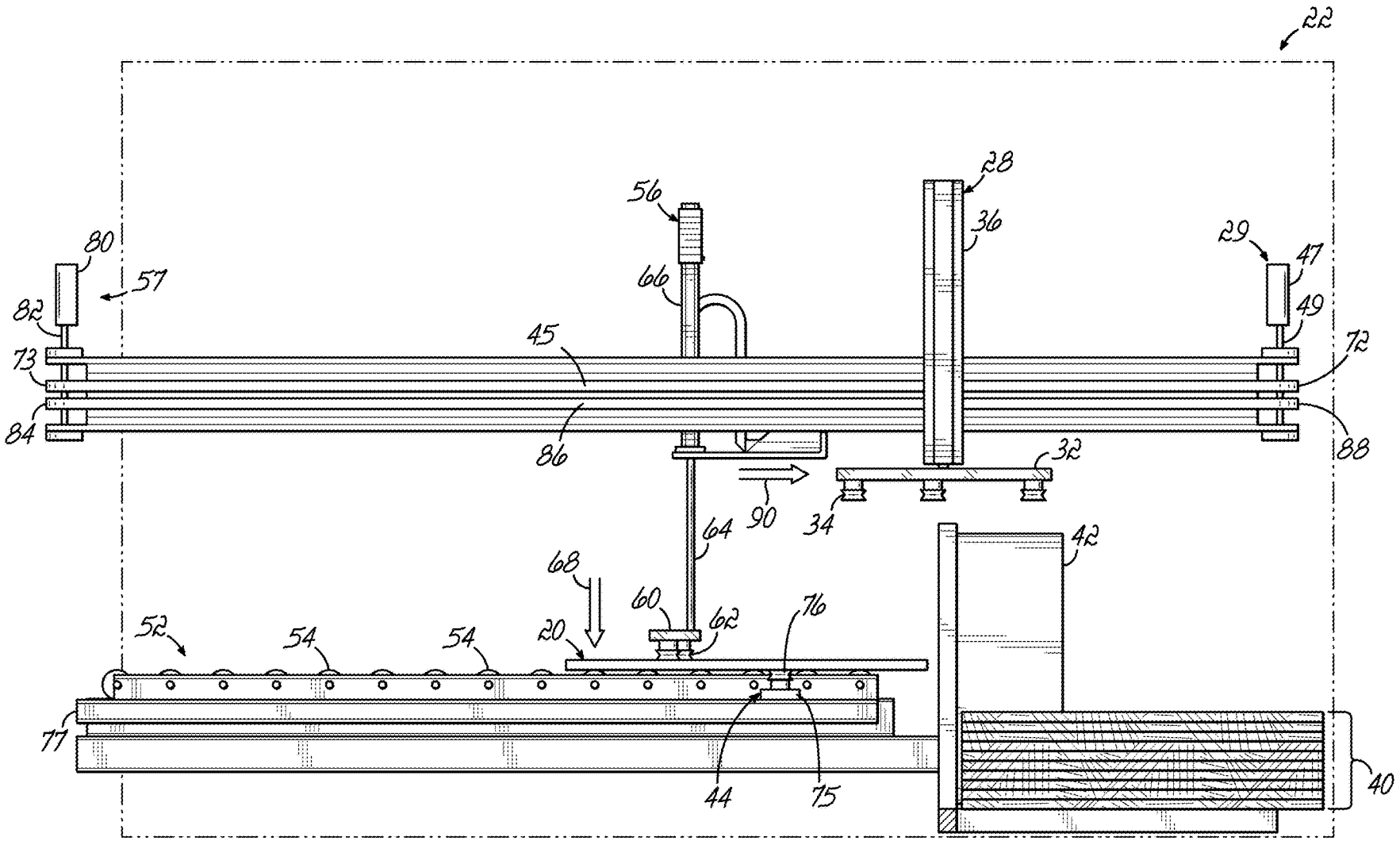
FIG. 6 is a cross-sectional view like FIG. 5A showing the picker actuator moving towards its home position and the erector actuator being engaged with the flattened box.
Figure 7:
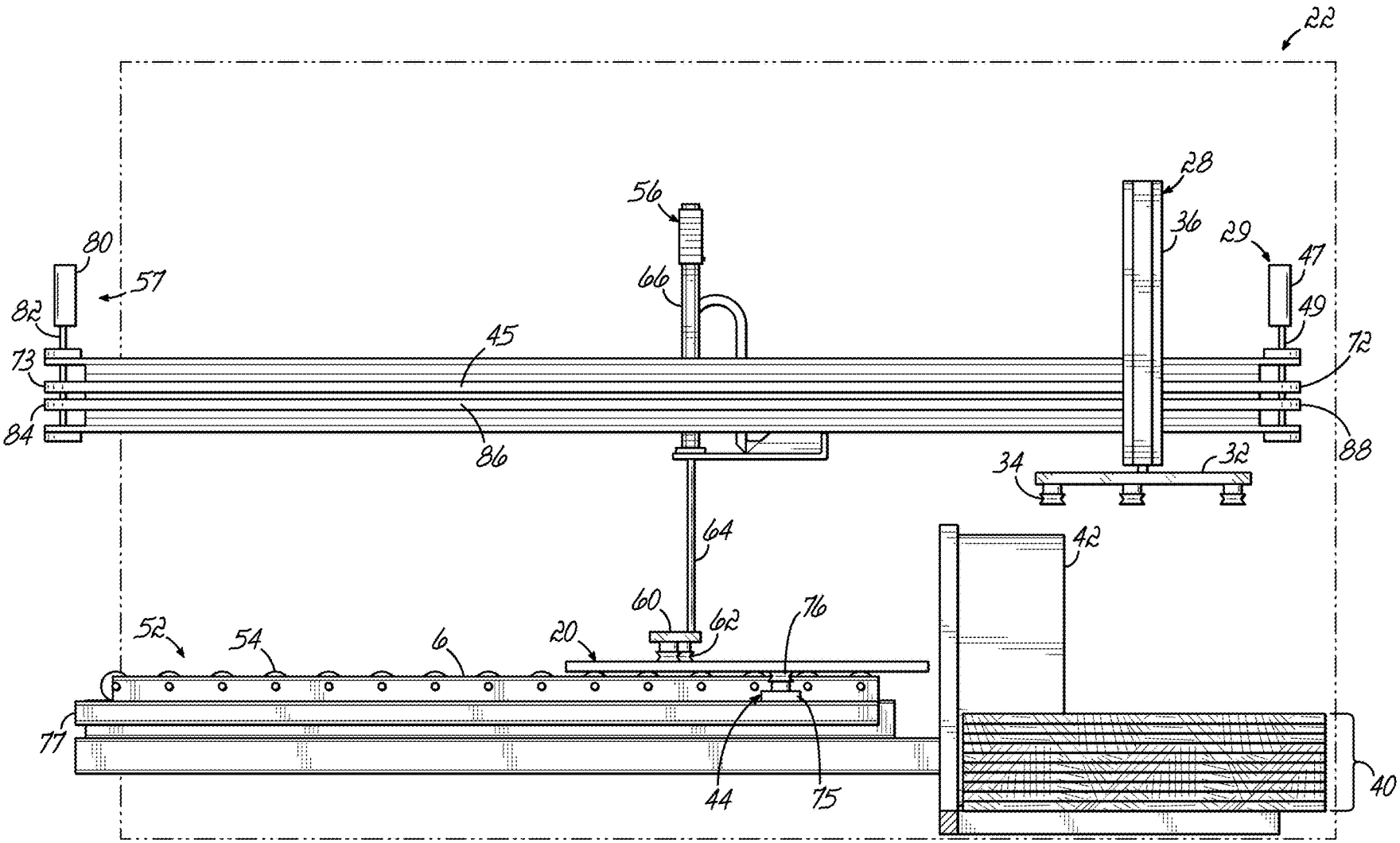
FIG. 7 is a cross-sectional view like FIG. 6 showing the picker actuator in its home position and the erector and transport actuators being engaged with the flattened box.

As shown in FIG. 6, the first controller 50 further activates the picker servo motor 47 to rotate the picker belt 45 to move the picker actuator 28 along with the picker plate 32 and associated picker suction cups 34 upstream towards their home position while the picker plate 32 is in its raised position. Arrow 90 of FIG. 6 shows the upstream movement of the picker actuator 28 towards its home position with the picker plate 32 raised. FIG. 7 shows the picker actuator 28 in its home position.

As shown in FIG. 5, the first section 22 of apparatus 10 further comprises an erector actuator 56 which moves horizontally via an erector mover 57. The erector actuator 56 is shown in its home position in FIGS. 2, 3 and 4. The erector actuator 56 comprises an erector plate 60 to which a plurality of erector suction cups 62 are attached. Although two erector suction cups 62 are shown, the drawings are not intended to be limiting.

The erector actuator 56 moves upstream and downstream via the erector mover 57 shown in FIGS. 5-8. The erector mover 57 comprises an erector servo motor 80 which rotates a shaft 82 which rotates a drive pulley 84. An erector belt 86 passes around drive pulley 84 along with a driven pulley 88.

As best shown in FIG. 6, the erector actuator 56 further comprises an erector rod 64 which moves vertically from an erector cylinder 66. The erector actuator 56 is controlled by first controller 50 to move the erector rod 64 vertically. The lower end of the erector rod 64 is welded or otherwise secured to the erector plate 60.

As shown in FIG. 5, while flattened box 20 is still engaged with the picker suction cups 34 of the picker actuator 28 and the transport suction cups 76 of the transport actuator 44 while being supported by the rollers 54 of roller assemblies 52 at the transfer location, the erector actuator 56 is moved upstream (to the right in FIG. 5) by rotation of the erector belt 86. The erector belt 86 is rotated by rotation of the drive pulley 84 which is activated by the erector servo motor 80.

The erector servo motor 80 is activated by the first controller 50 to move the erector actuator 56 from a home position shown in FIG. 4 in the direction of arrow 58 upstream (to the right in FIG. 5A) to an erecting position shown in FIG. 6. The erector actuator 56 is secured to the erector belt 86 so that rotation of the erector belt 86 moves the erector actuator 56 horizontally either upstream (to the right in FIG. 5) or downstream. As shown in FIG. 6, the erector actuator 56 arrives at its erecting position after the picker actuator 28 has moved upstream from its transfer location shown in FIGS. 5 and 5A. See arrow 90 of FIG. 6.

With the erector actuator 56 at the erecting position shown in FIG. 6, the erection rod 64 of the erector actuator 56 is moved downwardly in the direction of arrow 68 of FIG. 6 until the erector suction cups 62 contact an upper surface of the flattened box 20 while the flattened box 20 is supported by the rollers 54 at the transfer location shown in FIG. 6.

The first controller 50 then activates the erector suction cups 62 by supplying air to the erector suction cups 62 to secure the erector suction cups 62 to an upper surface of the flattened box 20.

Figure 8:
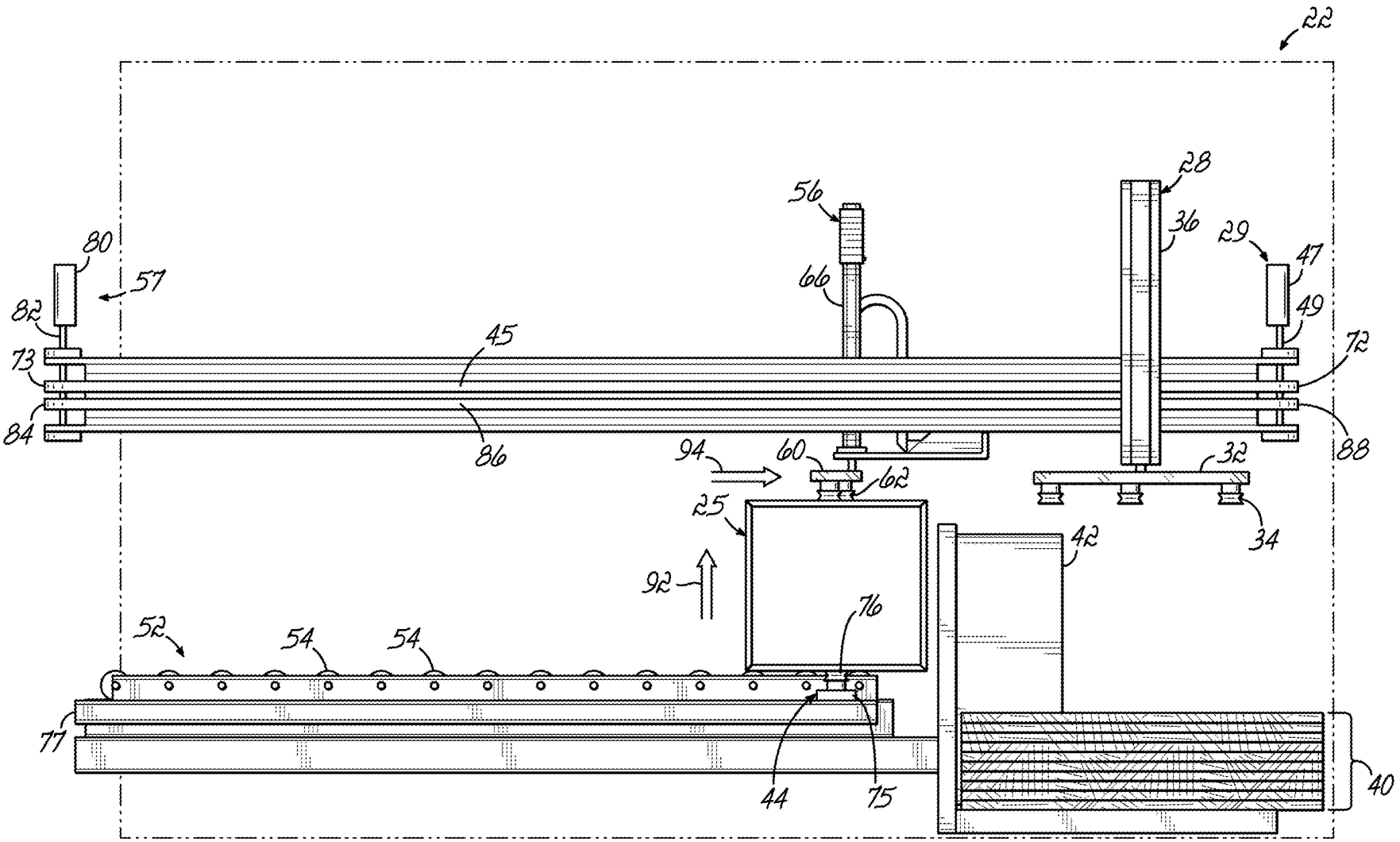
FIG. 8 is a cross-sectional view of the portion of the first section of the apparatus shown in FIG. 4 showing the picker actuator in its home position and the erector and transport actuators erecting the flattened box.

FIG. 8 shows the transport suction cups 76 of the transport actuator 44 engaged with the lower surface of the box 20 while the flattened box 20 is being erected by the erector actuator 56 via the first controller 50. The first controller 50 has the erector cylinder 66 raise the erector rod 64 as shown by arrow 92 while simultaneously moving the erector belt 86 upstream to move the erector plate 60 and erector suction cups 62 upstream as shown by arrow 94 of FIG. 8. During this erection process, the first controller 50 keeps air supplied to the erector suction cups 62 of the erector actuator 56. The flattened box 20 thus transforms from a flattened box to an erected box 25 having an open top and open bottom.

FIG. 9 shows the erected box 25 in the same position shown in FIG. 8 but looking down on the erected box 25. As best shown in FIG. 8, after the flattened box 20 is erected, the erector suction cups 62 attached to the erector plate 60 remain engaged with the erected box 20 due to air supplied by an air supply (not shown) and the transport suction cups 76 attached to the transport plate 75 remain engaged with the erected box 25 due to air supplied by an air supply (not shown).

The transport actuator 44 underneath the erected box 20 and the erector actuator 56 above the erected box 25 remain engaged with the erected box 25 as the erected box 25 moves downstream. Movement of the erected box 25 is controlled by the first controller 50 moving these two actuators (the erector actuator 56 and transport actuator 44). It is also within the scope of the present invention that only one of the actuators moves the erected box 25 downstream.

Figure 10:
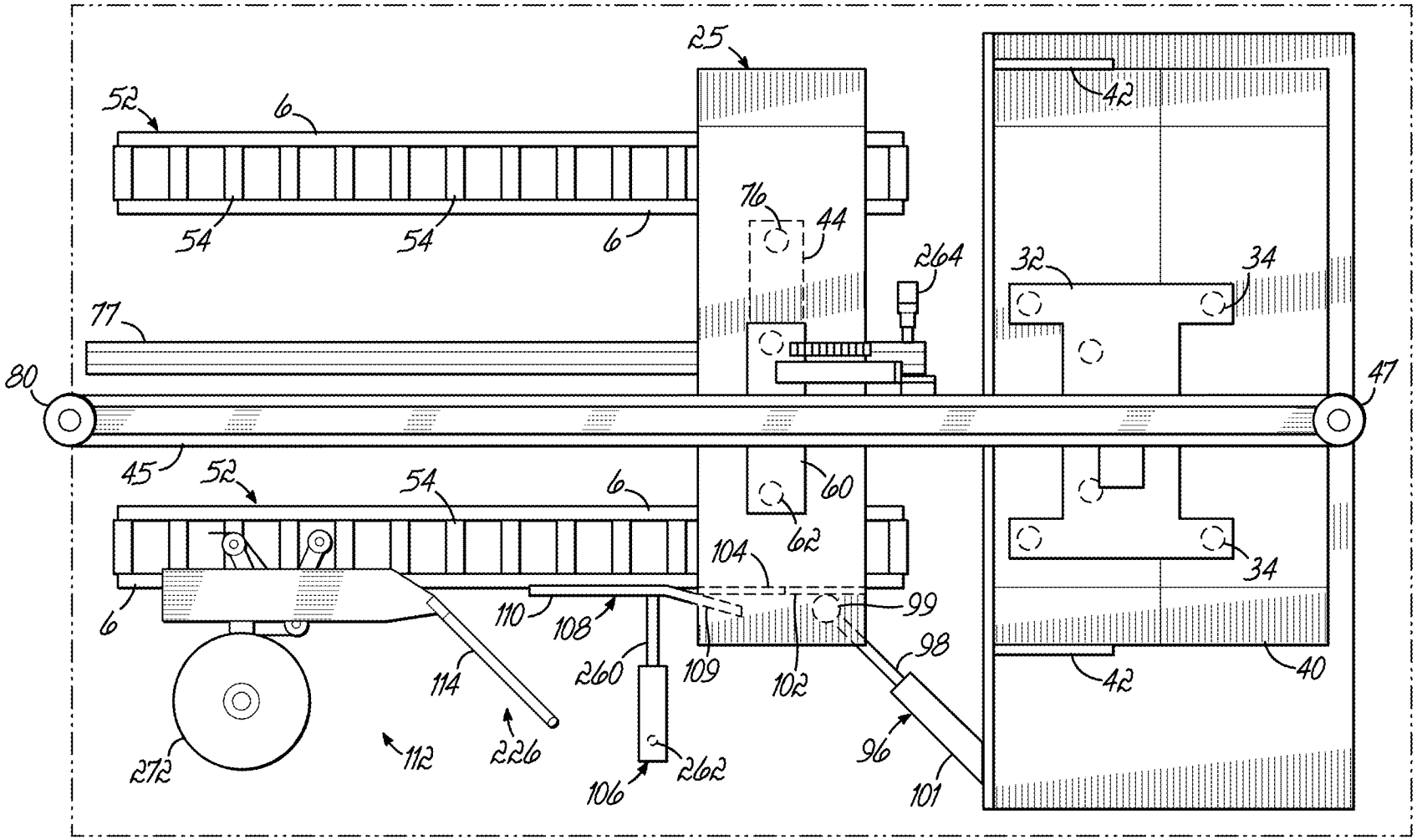
FIG. 10 is a top view like FIG. 9 showing the vertical flaps being closed.
Figure 10A:
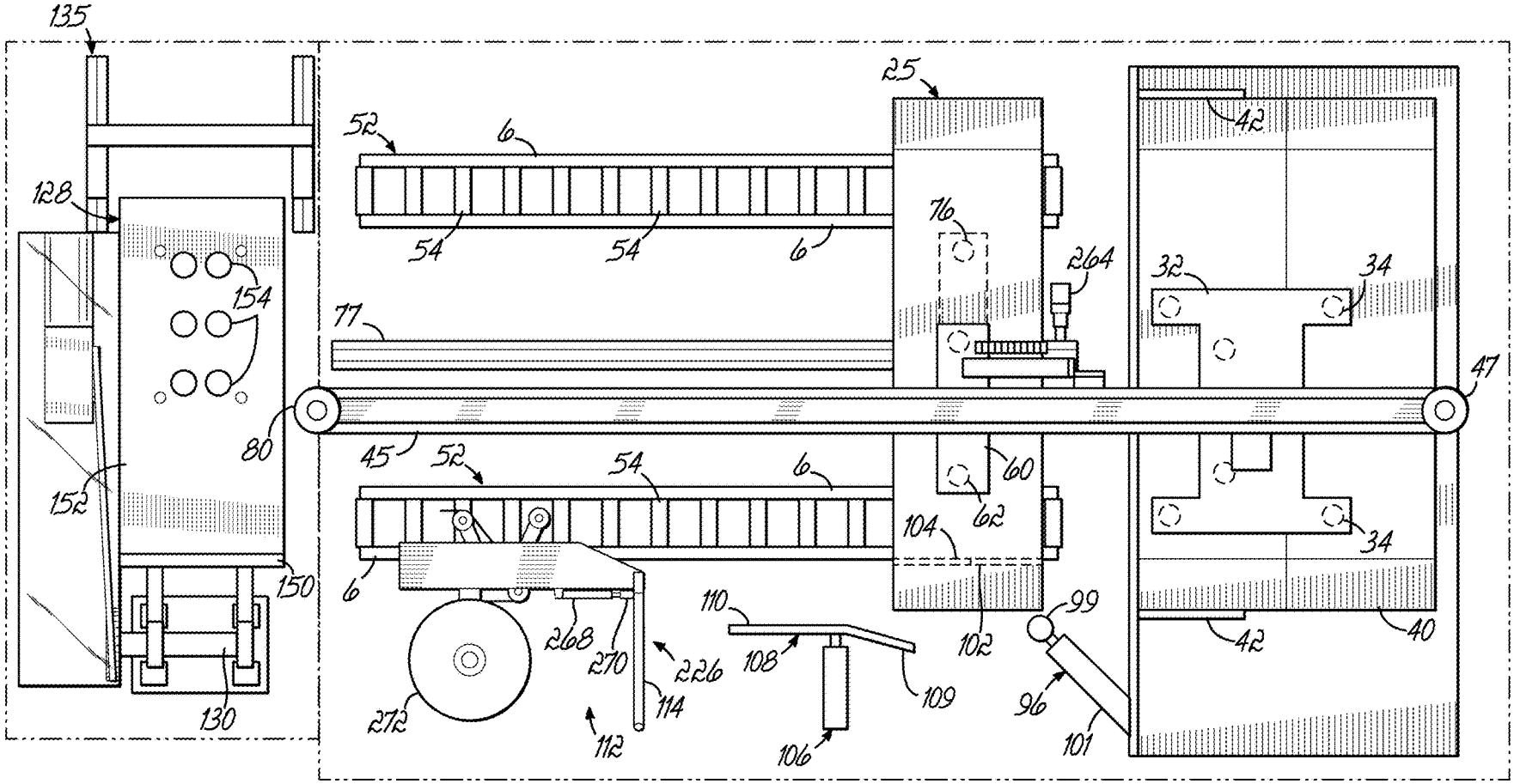
FIG. 10A is a top view showing the horizontal flap actuator being in a retracted position.
Figure 10B:
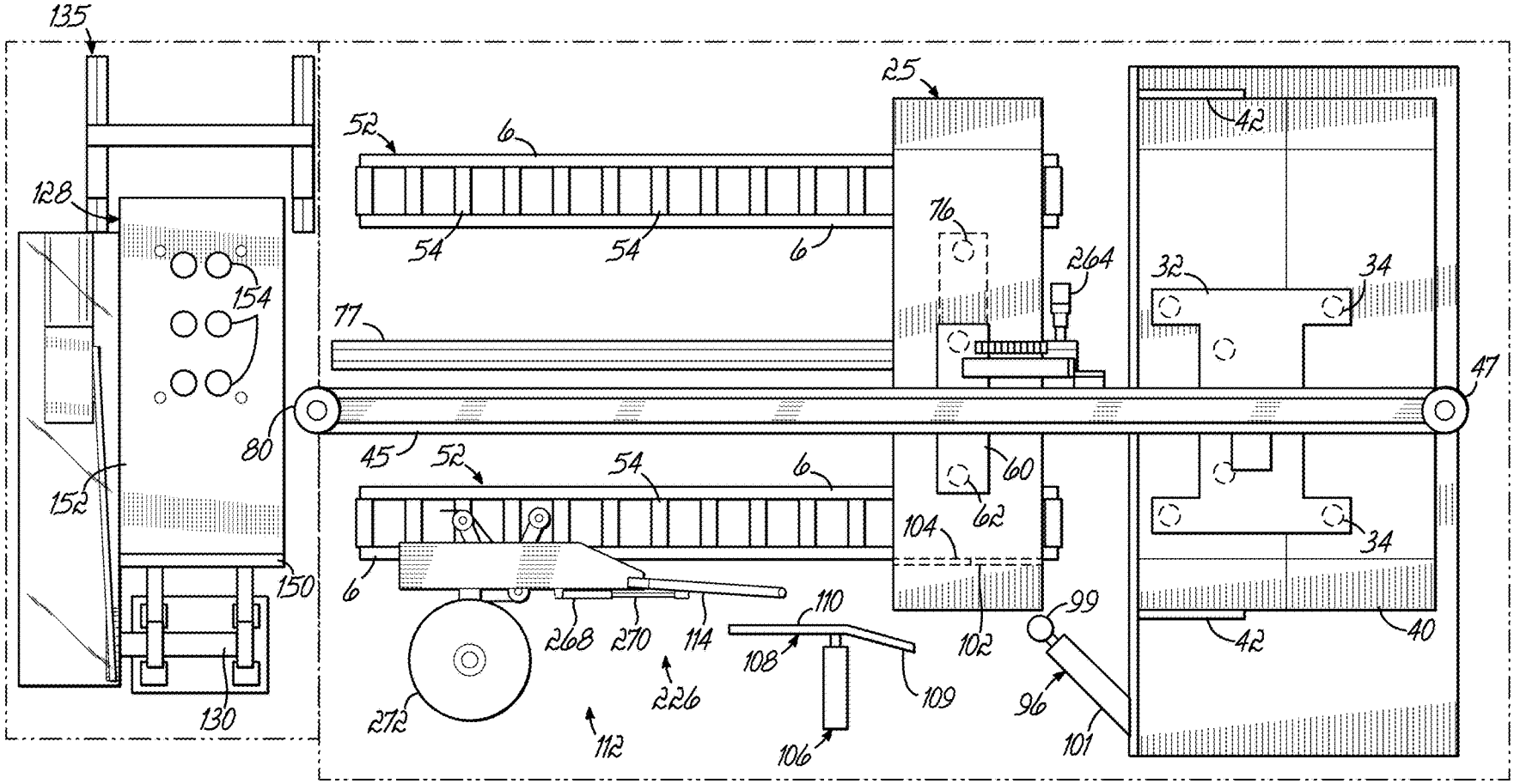
FIG. 10B is a top view showing the horizontal flap actuator being in a extended position.

FIG. 10 shows the erected box 25 slightly downstream from its erected position shown in FIGS. 8 and 9. FIG. 10 shows activation of a front vertical flap closer 96 to move a rod 98 outwardly from an air cylinder 101 to close a first or front vertical flap 102 (the first or front vertical flap 102 being upstream of the second or rear vertical flap 104). The rod 98 has a ball 99 at the outer end thereof which pushes the front vertical flap 102 closed. The first controller 50 controls the timing of the front vertical flap closer 96. See FIG. 29.

As shown in FIGS. 9 and 10, as the transport and erector actuators 44, 56, respectively, move the erected box 25 downstream, the erected box 25 rolling along the rollers 54, a rear vertical flap closer 106 engages the second vertical flap 104 to close the second vertical flap 104. Although not shown, a second vertical flap closer like front vertical flap closer 96 may be used to close the second or downstream vertical flap 104.

In the embodiment shown, the rear vertical flap closer 106 has a plate 108 having an angled plate portion 109 and a straight plate portion 110 downstream of the angled plate portion 109. The rear vertical flap closer 106 is movable via a piston 260 and air cylinder 262 to move the plate 108 inward and outward. In operation, the rod 98 of the front vertical flap closer 96 is withdrawn after the first and second flaps 102, 104 are held closed by the plate 108 of the downstream or rear vertical flap closer 106. The third and fourth (or top and bottom) flaps 116, 118 of the erected box 25 (which are horizontal flaps in the illustrated embodiment) are closed outside the closed first and second box flaps 102, 104 by activation of a horizontal flaps actuator 226 controlled by first controller 50. As shown in FIGS. 10A and 10B, the horizontal flaps actuator 226 comprises an air cylinder 268 and an extendable rod 270 which pivot two arms 114. The two arms 114 converge together in a downstream direction. The arms 114 form a V-shape together and are used to close top and bottom flaps 116, 118 outside the closed first and second box flaps 102, 104. When the horizontal flaps actuator 226 is in an extended position, the extendable rod 270 is fully extended and the arms 114 contact the top and bottom flaps 116, 118 of the erected box 25, as shown in FIG. 10B. As shown in FIG. 10A, when the horizontal flaps actuator 226 is in a resting position, the extendable rod 270 is withdrawn and the arms 114 do not contact the top and bottom flaps 116, 118 of the erected box 25.

The first and second box flaps 102, 104 are vertical flaps while the top and bottom flaps 116, 118 are horizontal flaps in the illustrated embodiment. Although not shown, it is within the scope of the invention that the horizontal flaps be closed inside the vertical flaps.

Figure 11:
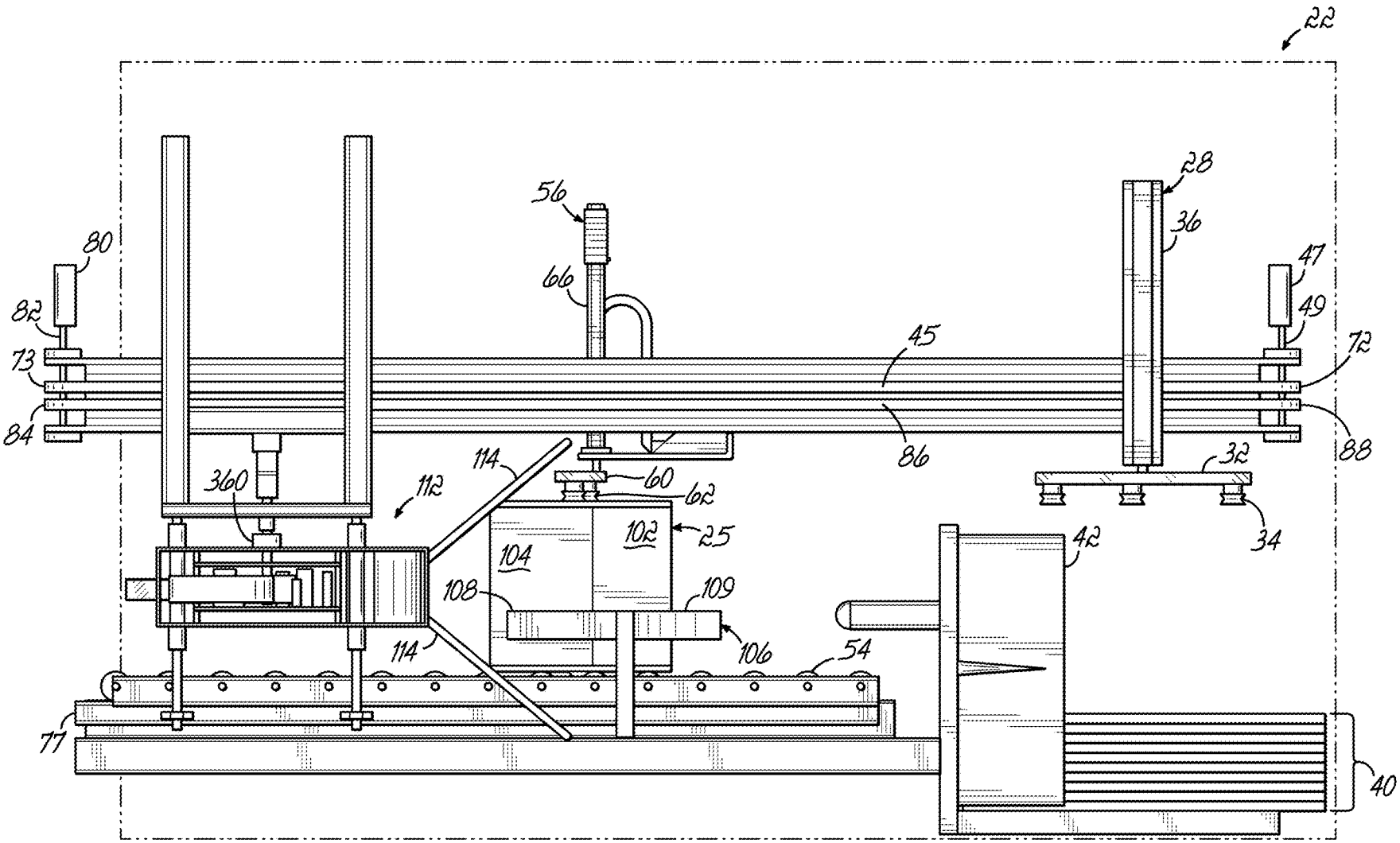
FIG. 11 is a side view like FIG. 10 showing the vertical flaps being closed.
Figure 27:
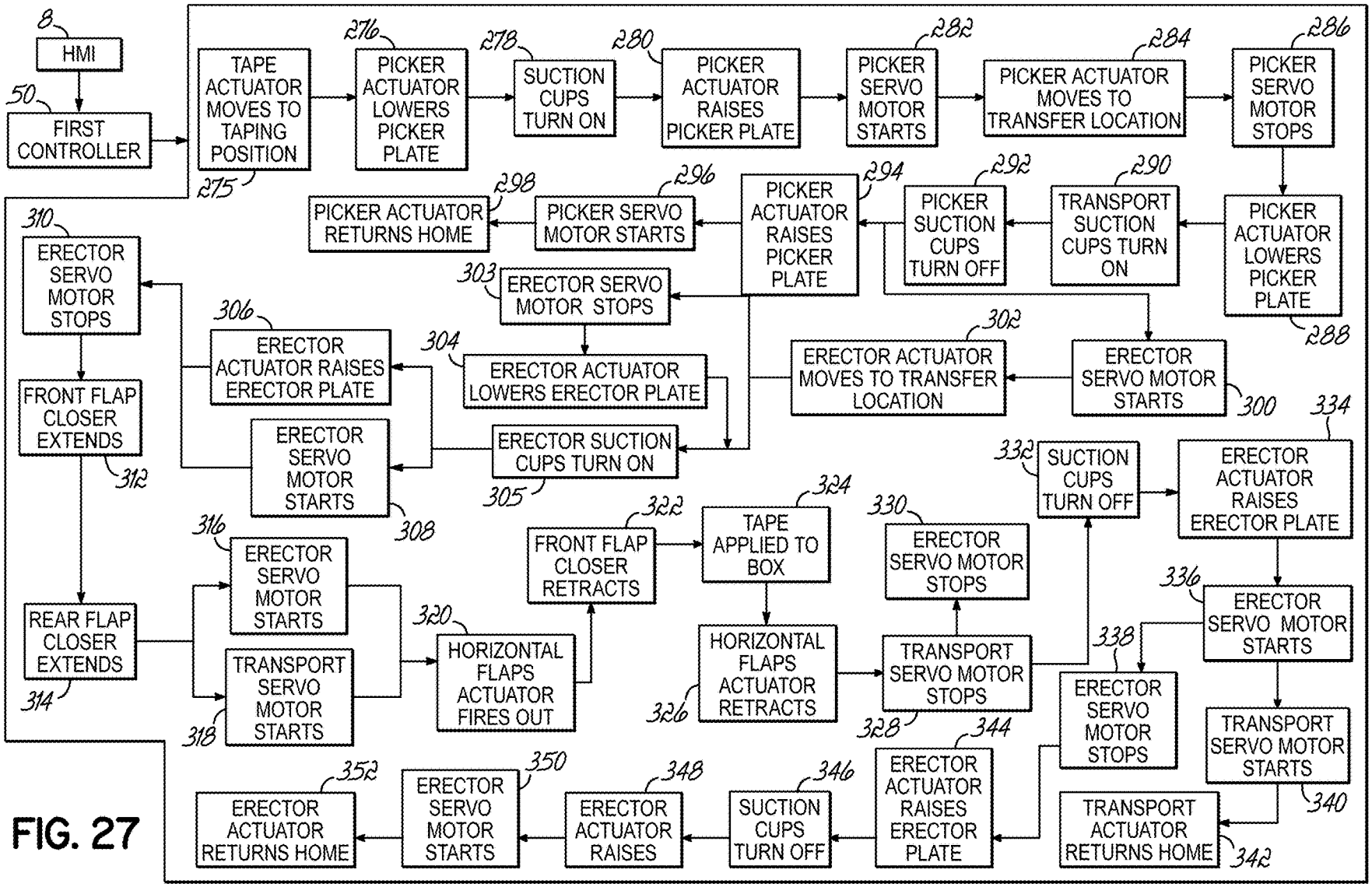
FIG. 27 is a flow chart of the operation of the first section of the apparatus.

FIG. 11 shows a tape assembly 112 downstream of the rear vertical flap closer 106. The tape assembly 112 includes a roll of tape 272. A tape actuator 360 moves the tape assembly 112 between a lower position shown in FIG. 2 to a taping position shown in FIGS. 2 and 11-15. The taping position is determined by the size of box to be erected and taped. As shown in FIG. 27, the first controller 50 determines the correct taping position based on input from the human/machine interface 8.

Figure 12:
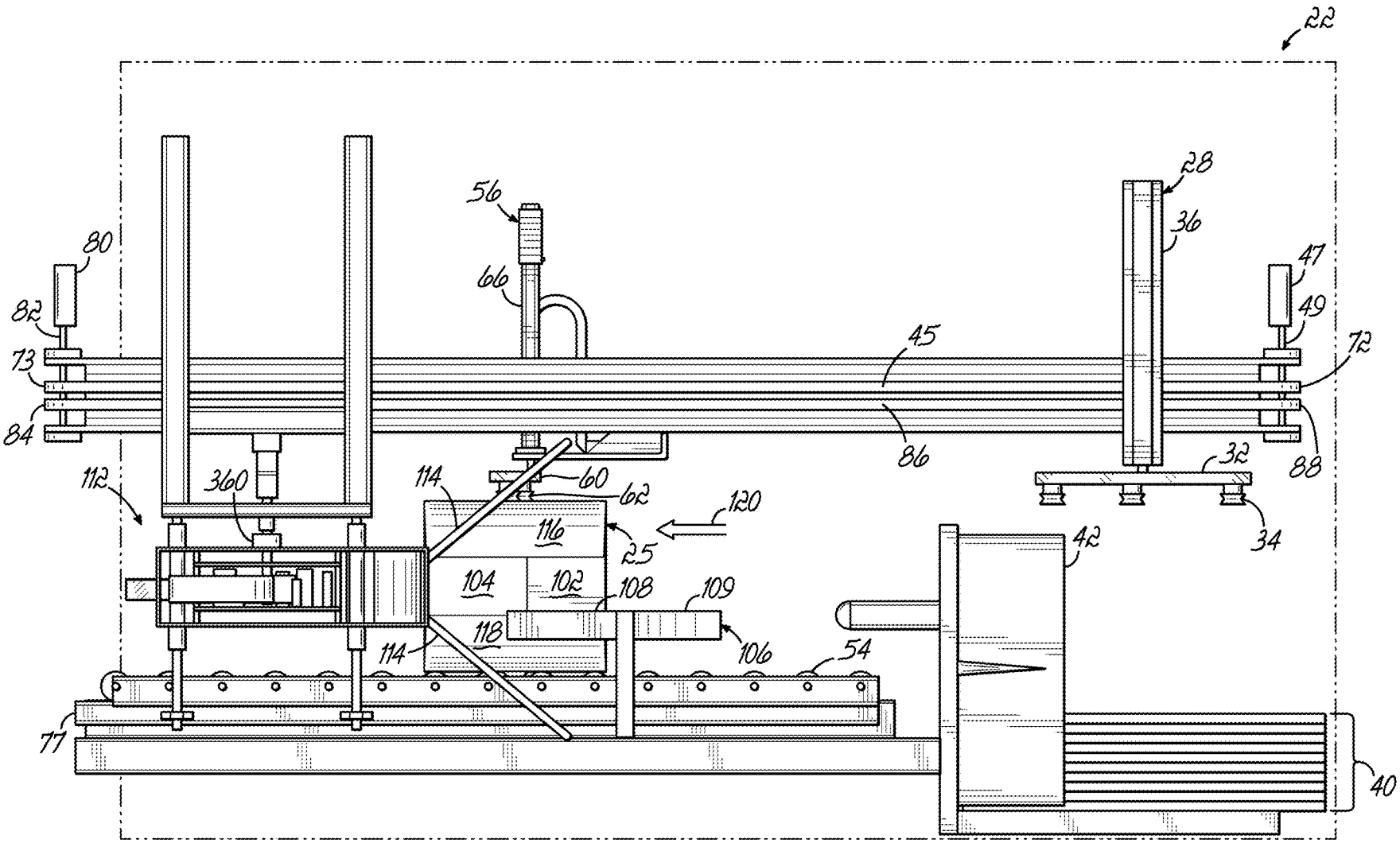
FIG. 12 is a side view like FIG. 11 showing the top and bottom flaps being closed.
Figure 13:
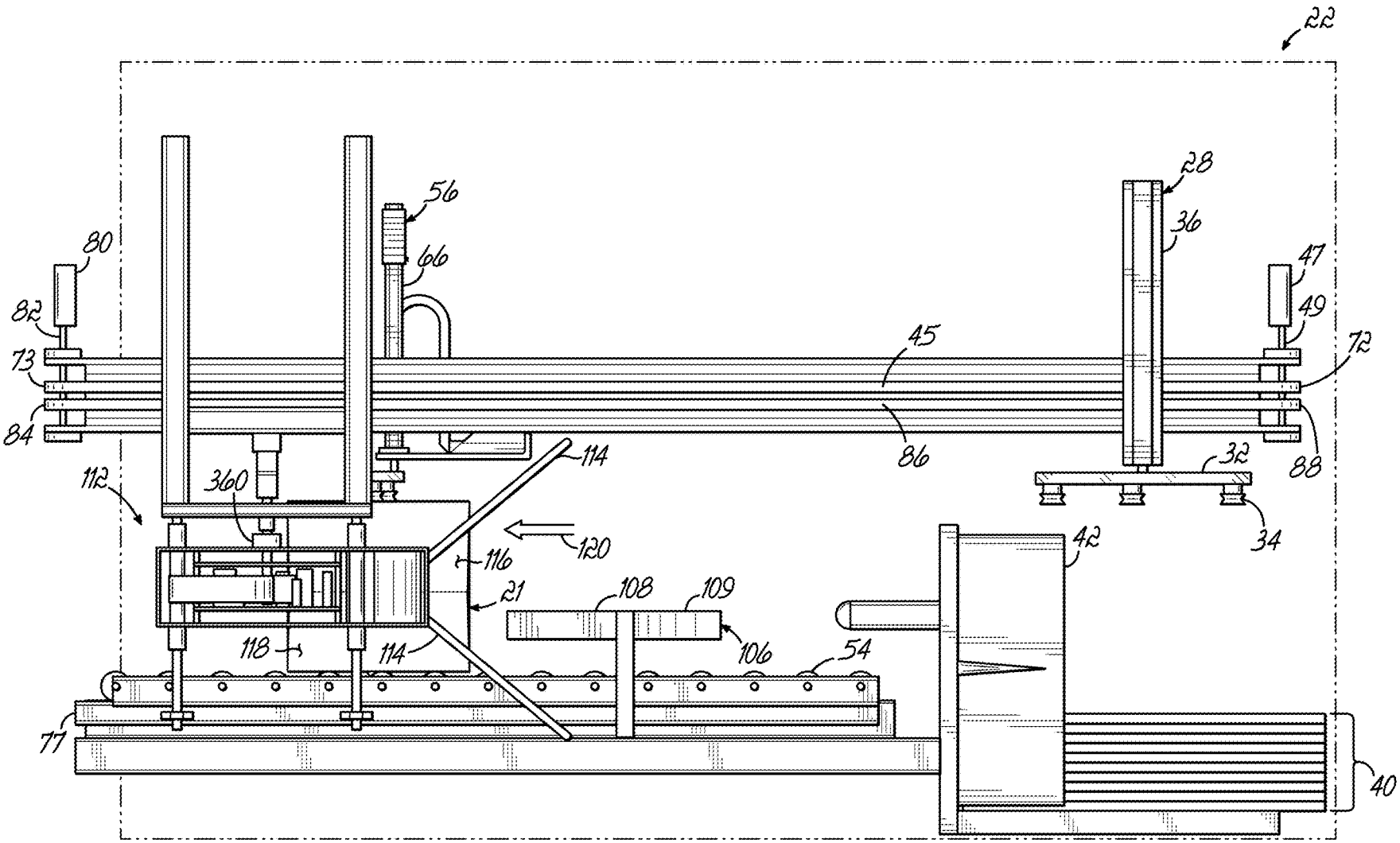
FIG. 13 is a side view like FIG. 12 showing the top and bottom flaps being taped together.
Figure 14:
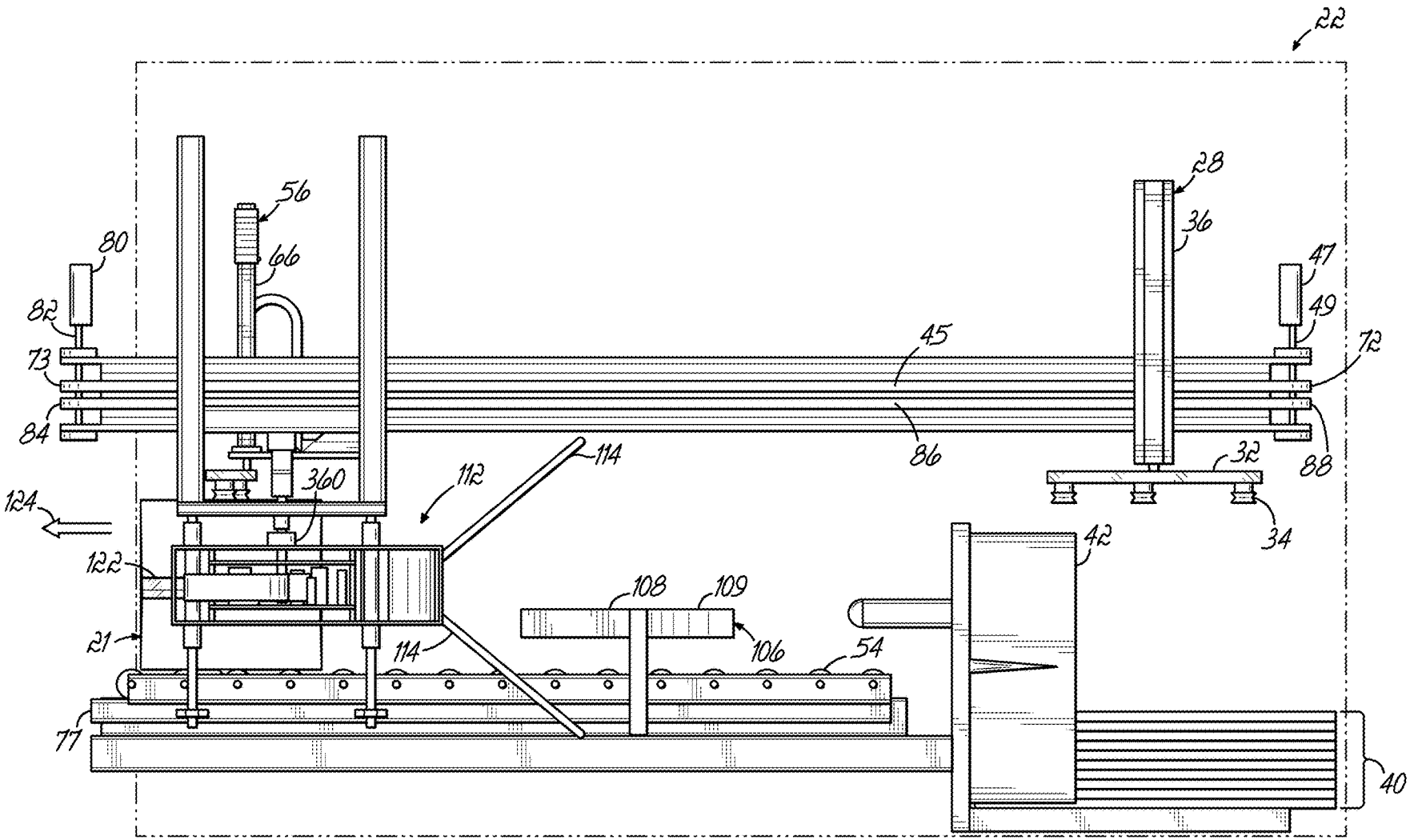
FIG. 14 is a side view like FIG. 13 showing the partially closed box of FIG. 13 exiting the first section and entering the second section of the apparatus.
Figure 16:
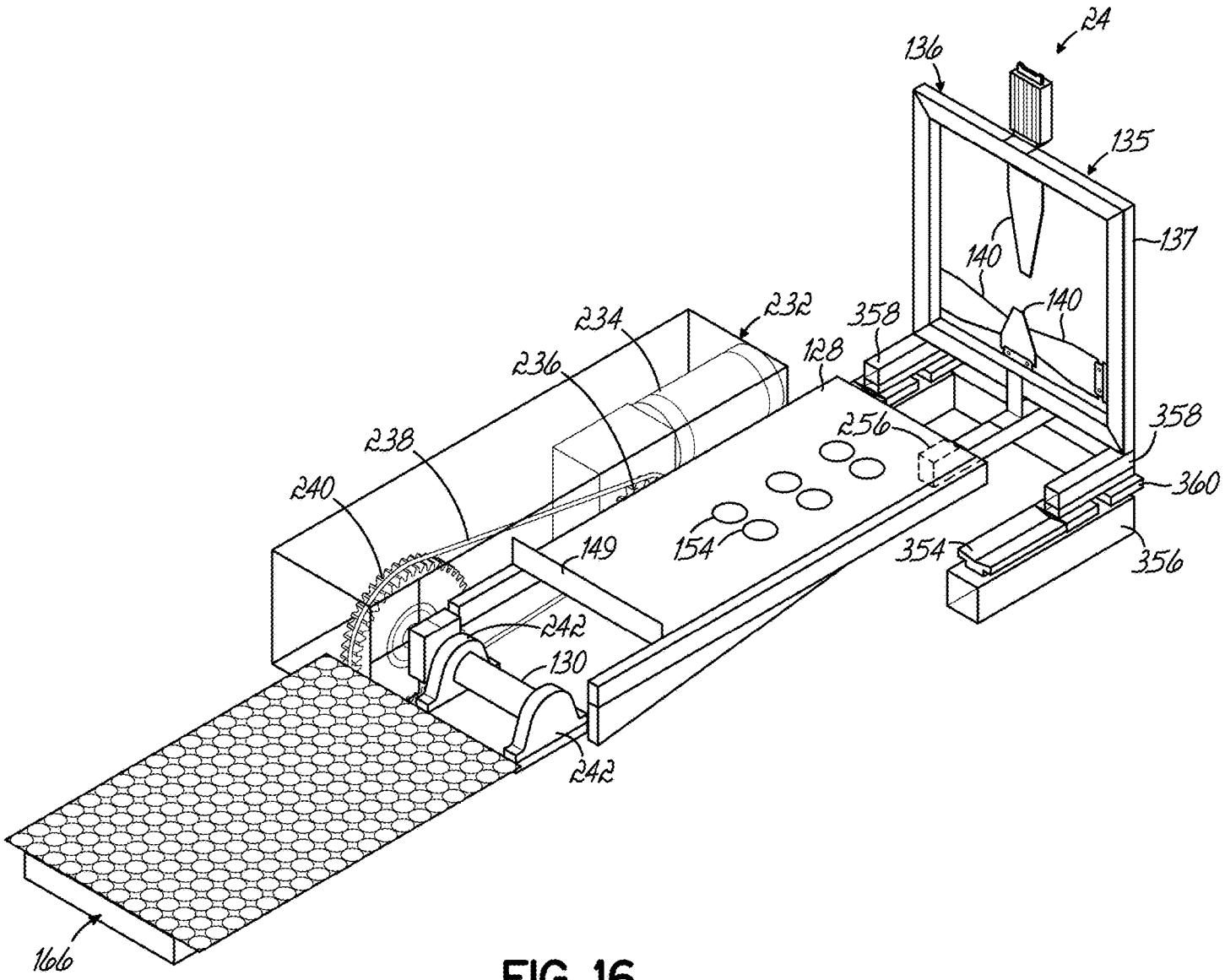
FIG. 16 is a perspective view of the lift mechanism used to raise and lower the lift table.

FIG. 12 shows the erected box 25 moving downstream in the direction of arrow 120, the suction cups of the transport and erector actuators 44, 56, respectively, being engaged with the erected box 25. The arms 114 of the horizontal flaps actuator 226 contact the top and bottom flaps 116, 118 and fold them over the closed first and second vertical flaps 102, 104. FIG. 13 shows the tape assembly 112 applying a strip of tape 122 shown in FIG. 14 to the top and bottom flaps 116, 118 to close one end 148 of the erected box 25. This creates a partially closed box 21 having a closed end 148 as shown in FIG. 16C. As shown in FIG. 14, the erected box 20 moves downstream in the direction of arrow 124 by the erector actuator 56 with the assistance of the transport actuator 44 during the taping process.

Figure 15:
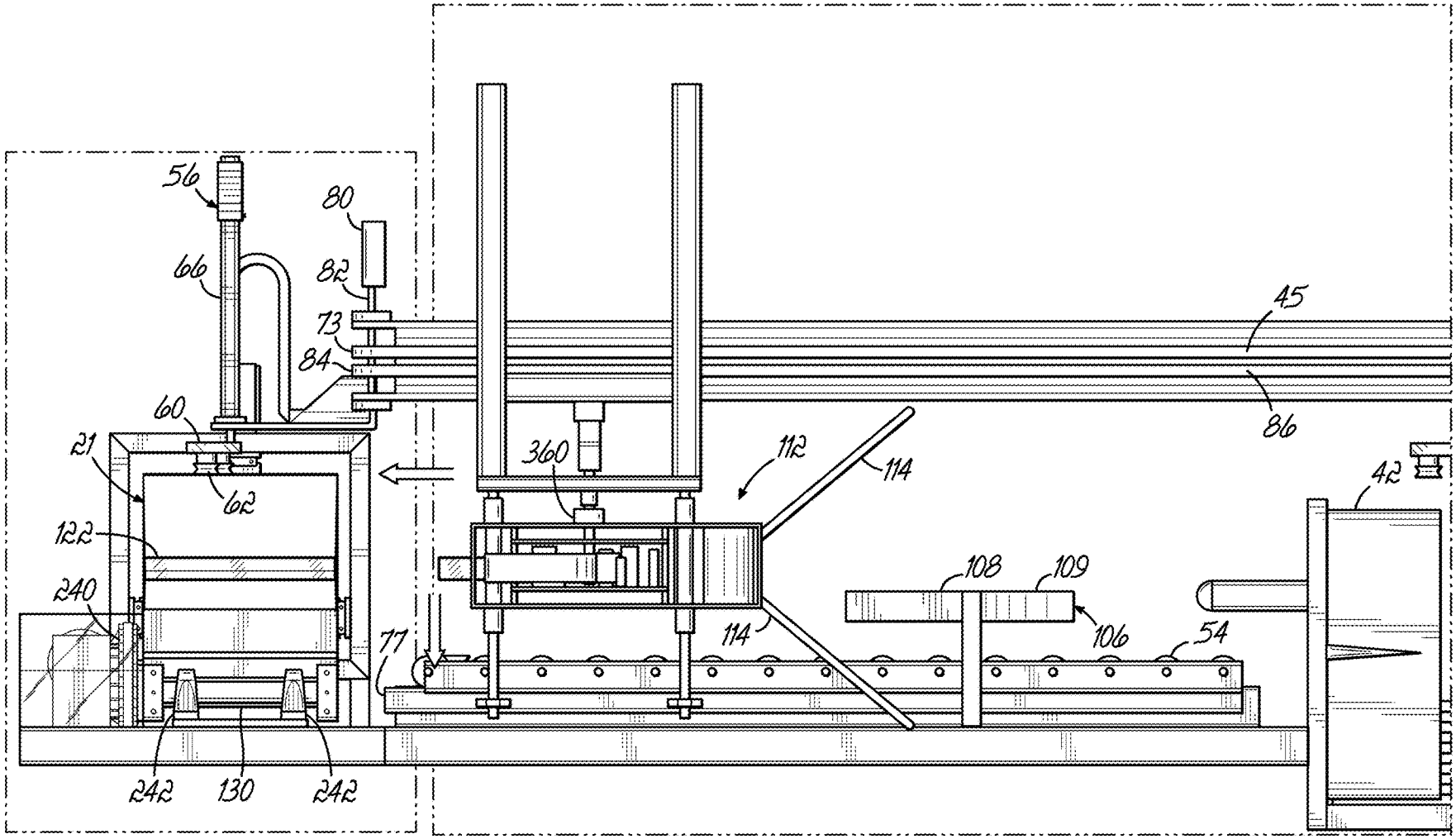
FIG. 15 is a side view like FIG. 14 showing the partially closed box of FIG. 13 in the second section of the apparatus.

FIG. 15 shows the partially closed box 21 downstream of the roller assemblies 52 in a loading position on a lift table 128. In this loading position, the erector actuator 56 disengages from the partially closed box 21 and moves to its home position.

Figure 16A:
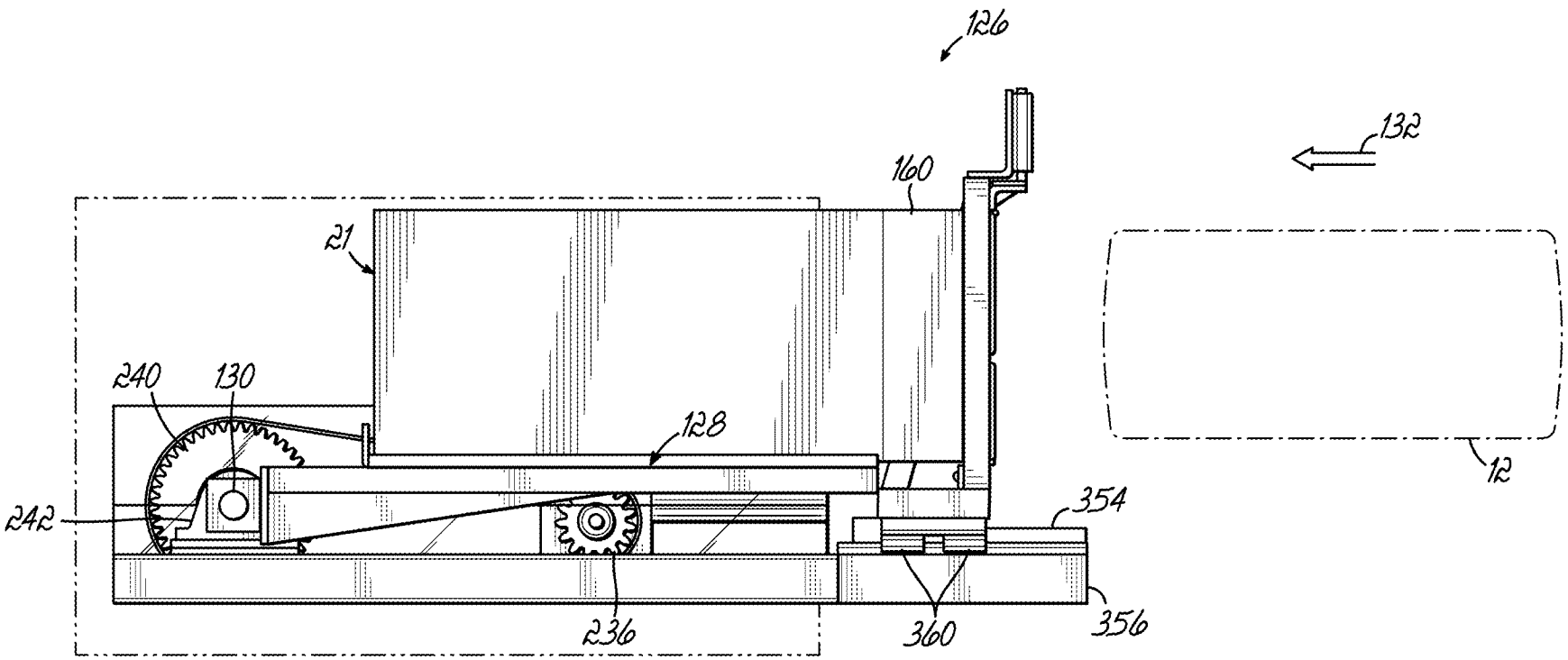
FIG. 16A is a schematic side view of a roll packed mattress aligned with an open end of the partially closed box at the second section of the apparatus.

FIG. 16A shows a portion of the loading station 126 of the apparatus 10 in the second section 24 of the apparatus 10. The partially closed box 21 is shown resting on a lift table 128 which pivots about a pivot pin 130. The closed end of the partially closed box 21 abuts against a stop 149. The lift table 128 is movable between a horizontal position shown in FIG. 16A and a vertical position shown in FIG. 16E via a lift mechanism 232. FIG. 16A shows a roll packed mattress 12 being loaded into the open end 134 of the partially closed box 21 in the direction of arrow 132.

Figure 30:
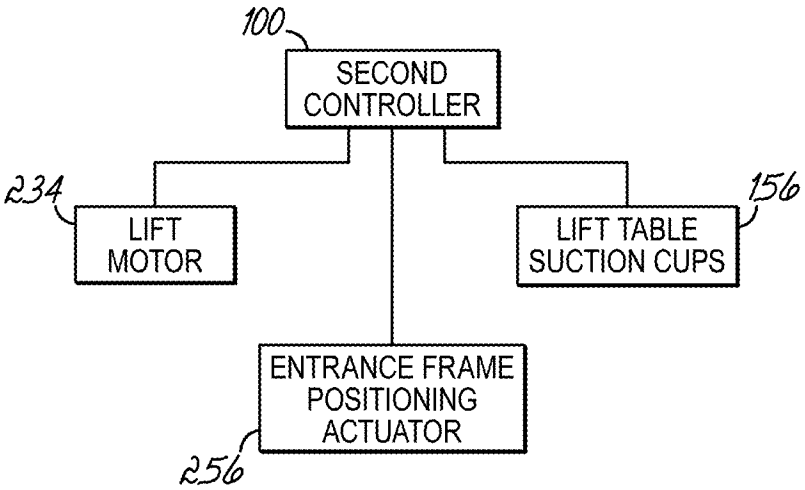
FIG. 30 is a flow chart further showing which parts of the second section of the apparatus are controlled by the second controller.

The lift mechanism 232 is best shown in FIG. 16. The lift mechanism 232 comprises a lift motor 234 which is controlled by the second controller 100, as shown in FIG. 30. The lift mechanism 232 further comprises a drive wheel 236 rotated by the lift motor 234. An endless drive belt 238 passes around the drive wheel 236 and a driven wheel 240. The driven wheel 240 is larger in diameter than the drive wheel 236. The driven wheel 240 is coupled to the pivot pin 130 which rotates inside bearings 242. Rotation of the pivot pin 130 moves the lift table 128 between its horizontal position shown in FIG. 16A and a vertical position shown in FIG. 16E.

Figure 16B:
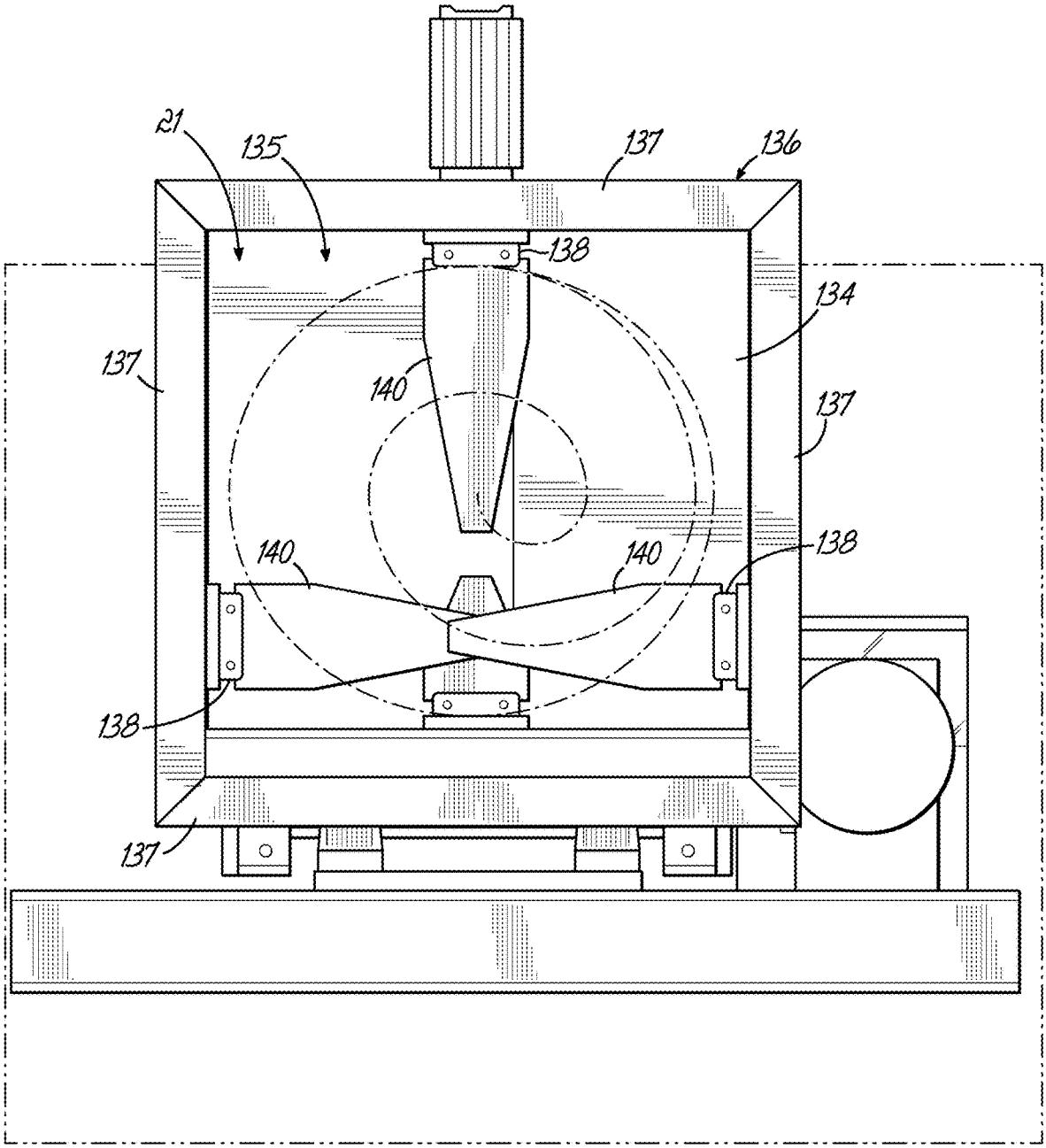
FIG. 16B is a schematic front view of the roll packed mattress inside the partially closed box at the second section of the apparatus.
Figure 16C:
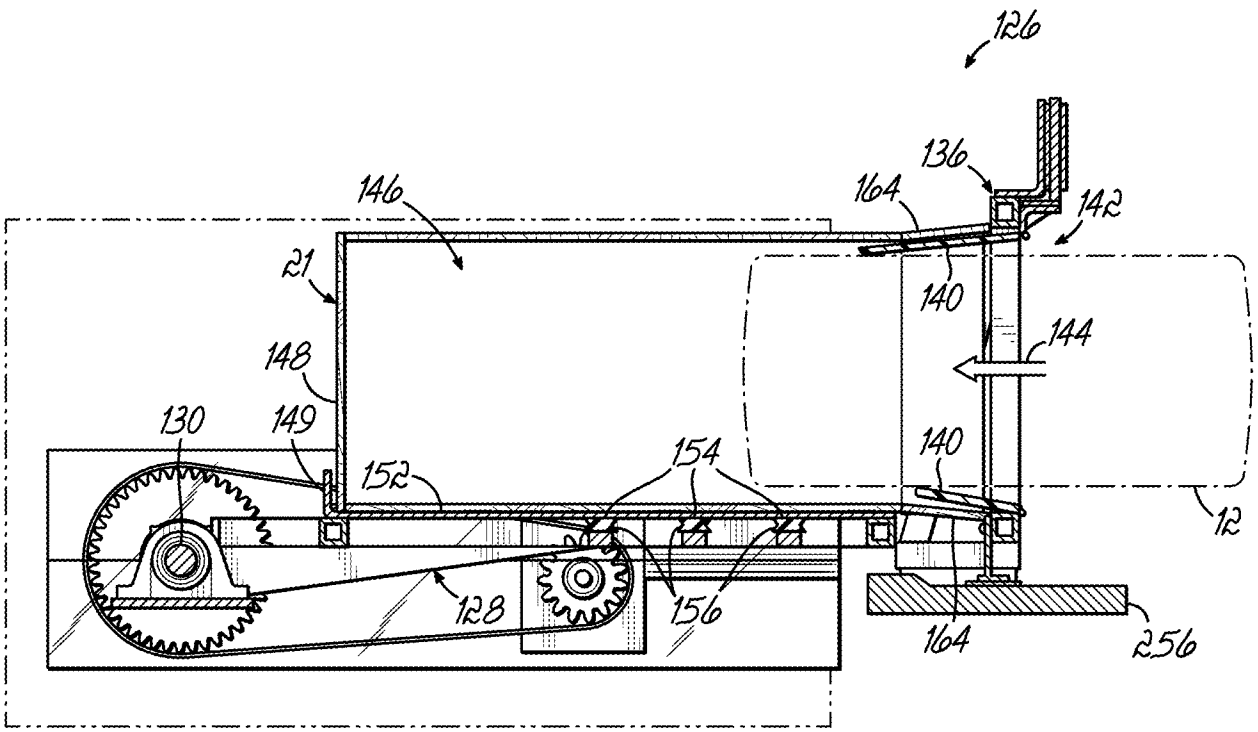
FIG. 16C is a schematic side view of the roll packed mattress further entering the open end of the partially closed box at the second section of the apparatus.

FIG. 16B shows an entrance assembly 135 including a generally rectangular entrance frame 136 through which the roll packed mattress 12 passes to enter the interior the partially closed box 21. The generally rectangular entrance frame 136 is moveable in a horizontal direction via the operation of an entrance frame positioning actuator 256. The entrance frame positioning actuator 256 may be any known linear actuator and is controlled by the second controller 100 as shown in FIG. 30. The entrance frame positioning actuator 256 moves the entrance frame 136 either away from or towards a stop 149 depending upon the size the box. Guides 354 are welded or otherwise secured to hollow members 356 of the second section 24 of the apparatus, as shown in FIG. 16. Stubs 358 are welded or otherwise secured to the generally rectangular entrance frame 136. Brackets 360 are welded or otherwise secured to the stubs 358 and engage the guides 354 during movement of the generally rectangular entrance frame 136.

Figure 16D:
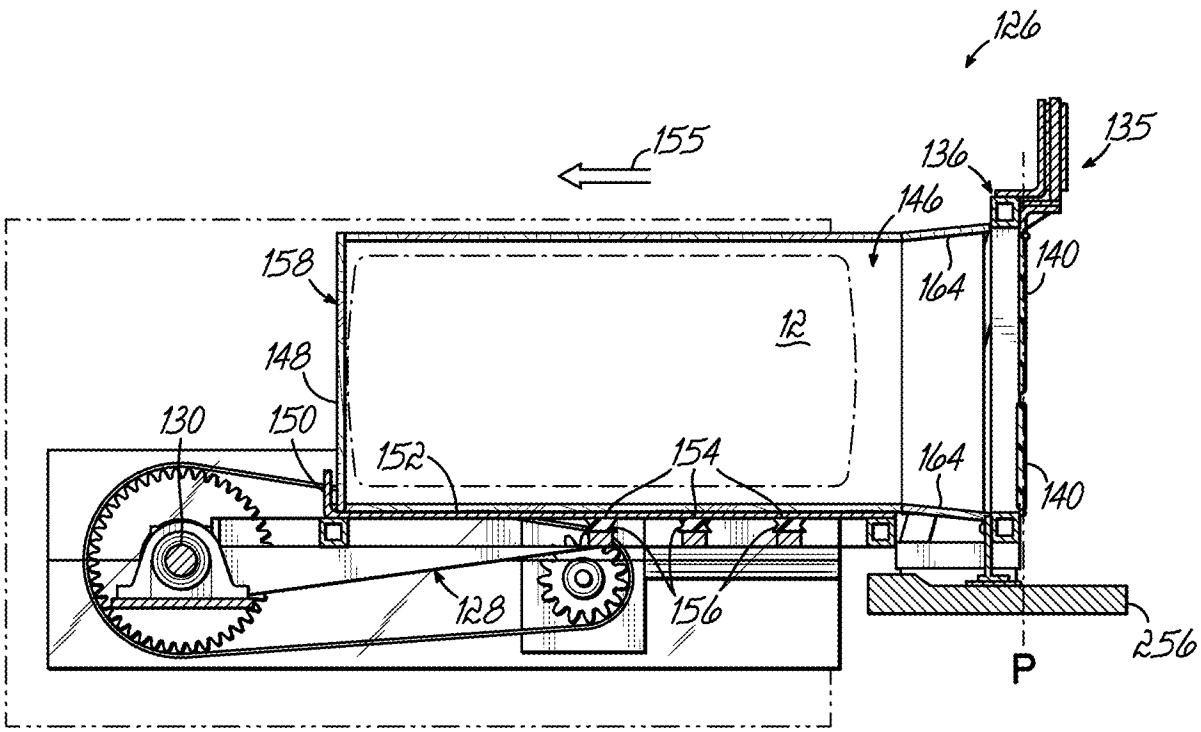
FIG. 16D is a schematic side view of the roll packed mattress inside the partially closed box at the second section of the apparatus, the fingers being back at their home positions.

Four finger brackets 138 are welded or otherwise secured to the generally rectangular entrance frame 136, one on each side 137 of the generally rectangular entrance frame 136. A metal finger 140 is attached to each of the finger brackets 138. Each metal finger 140 is tapered in width, narrowing as each finger 140 extends away from the finger bracket 138. One purpose of the metal fingers 140 is to raise and hold open flaps 160, 162, 164 of the partially closed box 21, as shown in FIGS. 16C and 16D. Although four metal fingers 140 are illustrated, the second section 24 of the apparatus 10 may have any number of fingers of any desired shape and made of any desired material to keep the flaps 160, 162, 164 open to assist inserting the roll packed mattress 12 inside the partially closed box 21.

FIG. 16C shows the roll packed mattress 12 passing through an opening 142 defined by the four sides 137 of the generally rectangular frame 136 and into an interior 146 of the partially closed box 21. See arrow 144. As the roll packed mattresses 12 is being loaded into the partially closed box 21, the closed end 148 of the partially closed box 21 abuts a stop 149 which extending upwardly from the generally planar surface 152 of the lift table 128. As best shown in FIG. 1, the generally planar surface 152 of the lift table 128 has a series of openings 154 (six being shown) below which are suction cups 156 controlled by the second controller 100. One suction cup 156 is below each opening 154. When the suction cups 156 are activated, they function to hold the partially closed box 21 against the generally planar surface 152 of the lift table 128 so the partially closed box 21 does not move in an undesirable direction such as falling off the lift table 128.

FIG. 16D shows the roll packed mattress 12 fully inside the interior 146 of the partially closed box 21, as depicted by the arrow 155. When the roll packed mattress 12 fully inside the interior 146 of the partially closed box 21, the fingers 140 of the entrance assembly 135 are generally in their home positions, in a vertically oriented plane P. A loaded box 158 is created when the roll packed mattress 12 fully inside the interior 146 of the partially closed box 21.

Figure 16E:
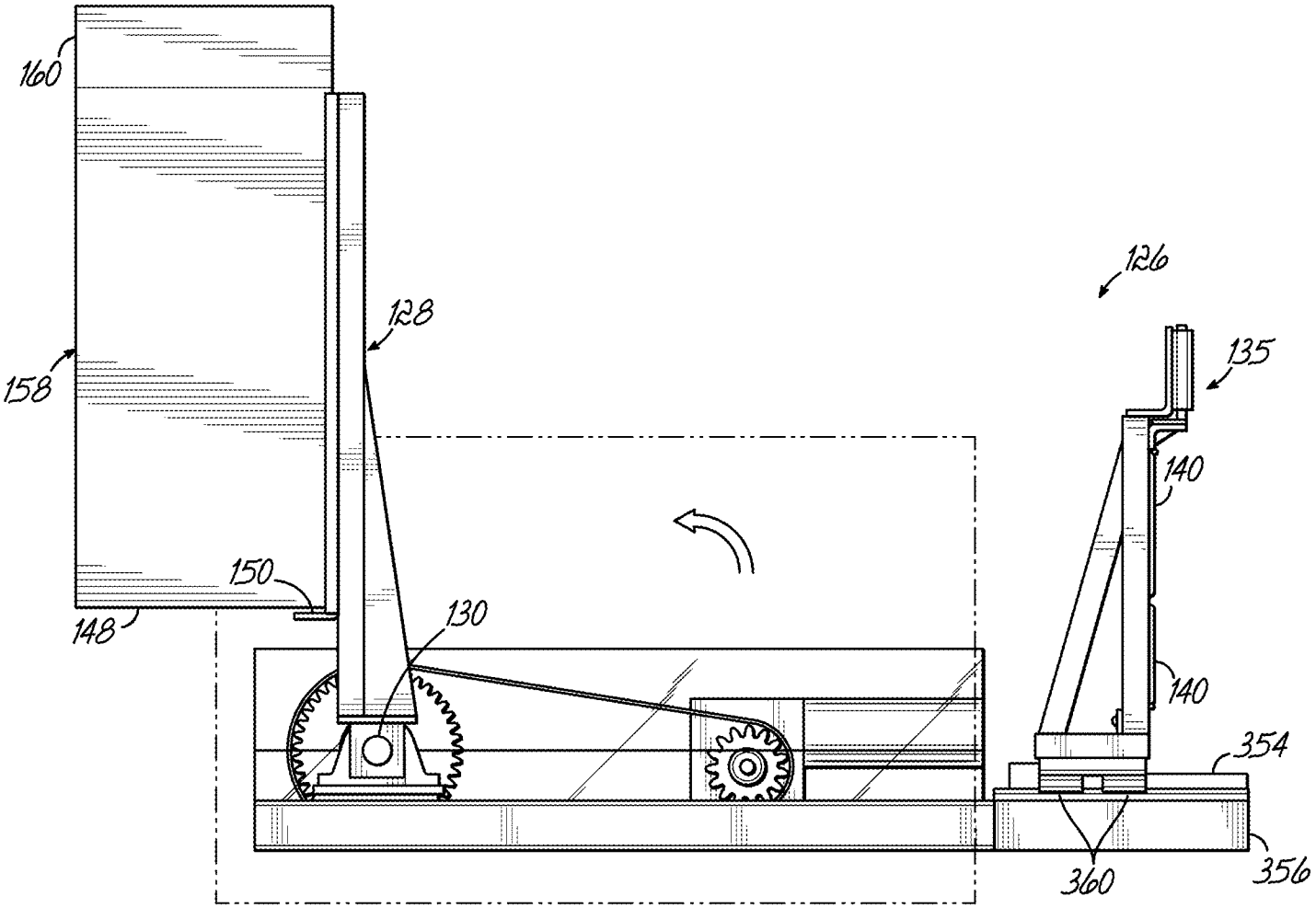
FIG. 16E is a schematic side view of the partially closed box being pivoted to a standing position by the lift table at the second section of the apparatus.
Figure 17:
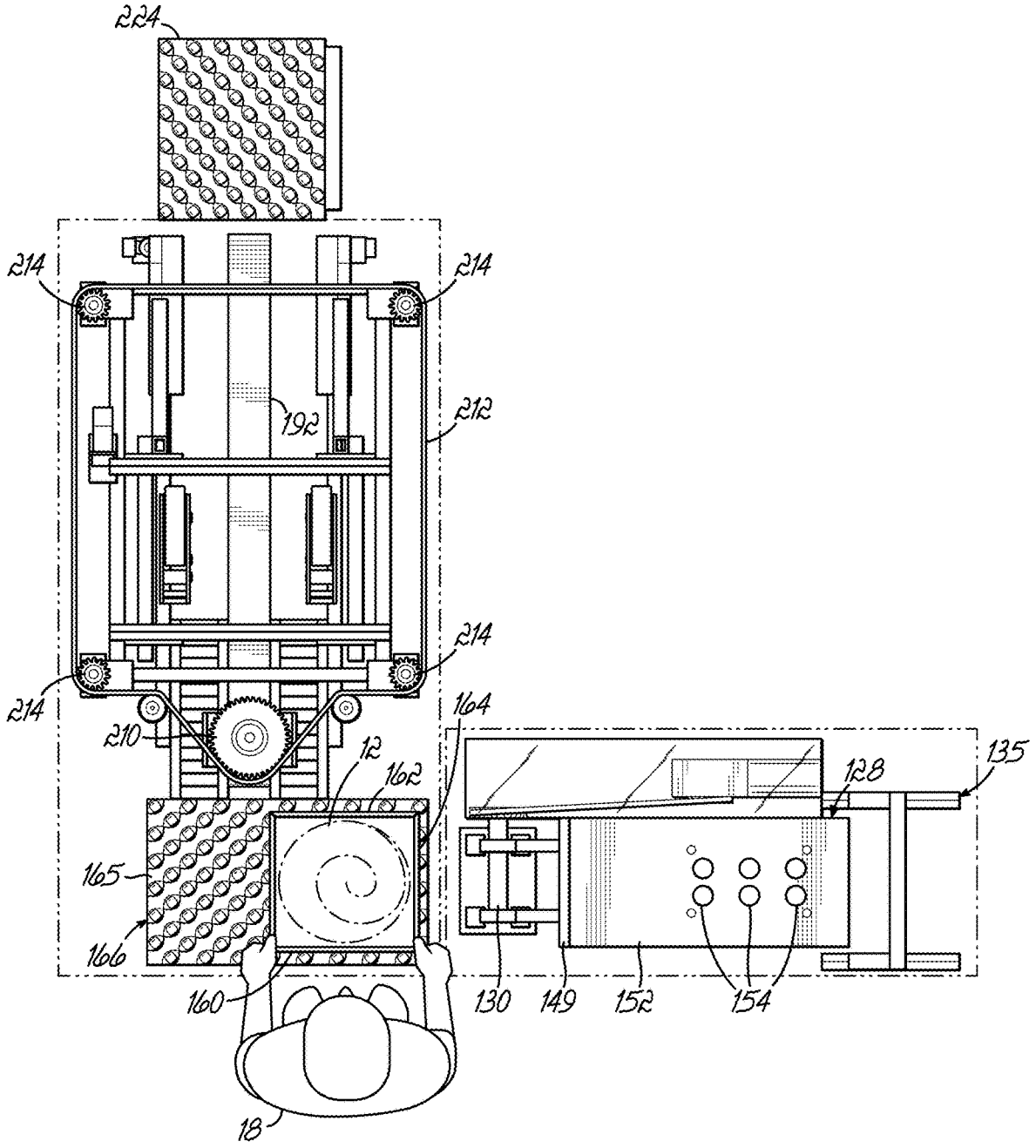
FIG. 17 is a top view of the second and third sections of the apparatus showing the partially closed box being held by an operator in its standing position at the weighing station.
Figure 18:
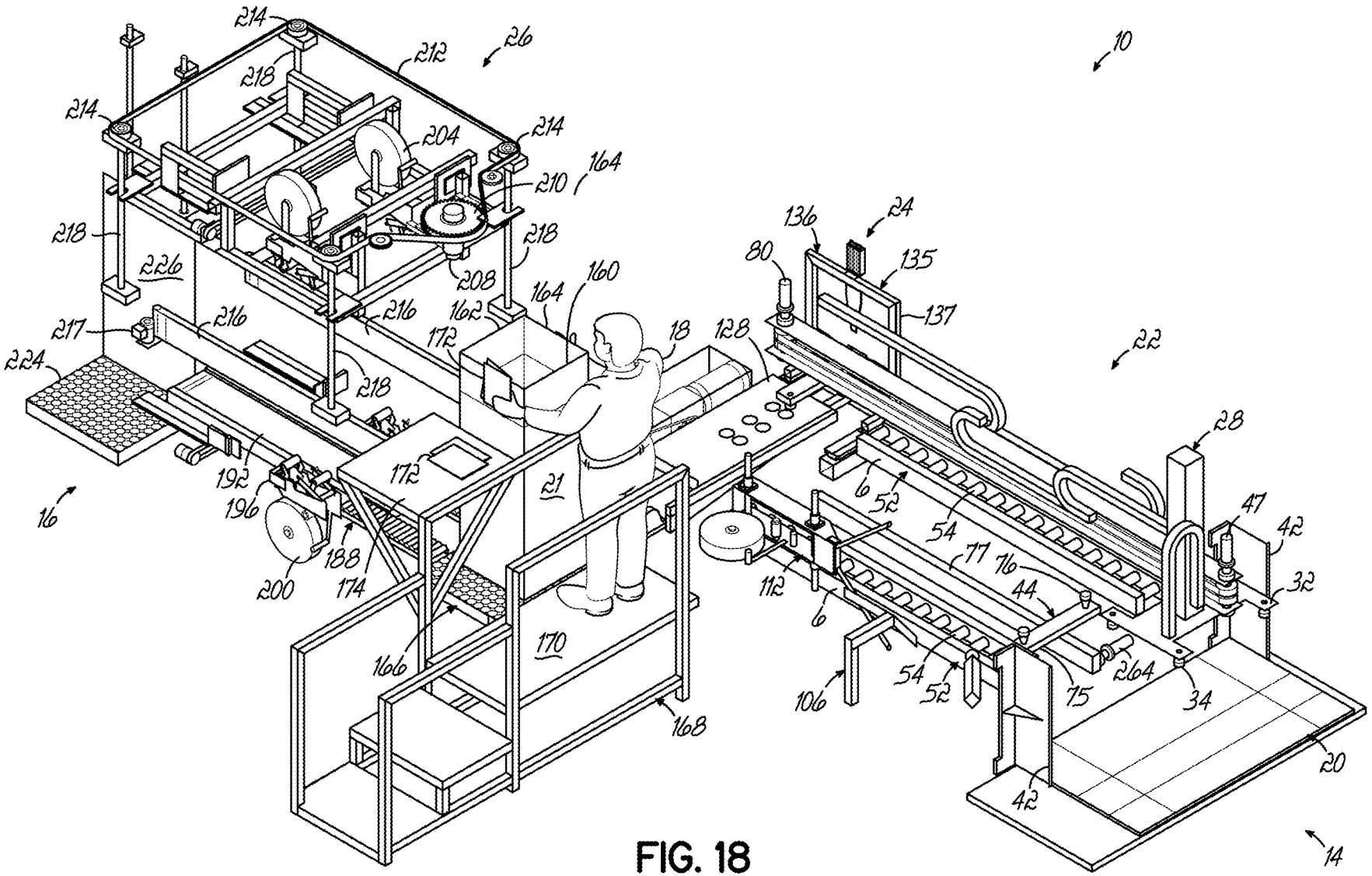
FIG. 18 is a front perspective view of the apparatus like FIG. 1 showing the operator inserting literature into a loaded box.

FIG. 16E shows the lift table 128 being pivoted about pivot pin 130 into an unloading position in which the lift table 128 is generally vertical. In this unloading position, the loaded box 158 may be separated from the lift table 128 by the operator 18 after the second controller 100 deactivates the suction cups 156. As best shown in FIGS. 16E, 17 and 18, the loaded box 158 has a front or first flap 160, a rear or second flap 162 and two side flaps 164.

As shown in FIG. 17, the operator 18 moves the loaded box 158 from its unloading position shown in FIG. 16E onto a platform 165 of a weighing station 166. The weighing station 166 measures the weight of the loaded box 158 and determines if the correct rolled pack mattress is in the correct box. The weight for a certain size roll packed mattress inside the correct sized box is expected to be in a weight range. As long as the human/machine interface 8 determines the weight of the loaded box 158 falls within the correct weight range, the human/machine interface 8 informs the operator to proceed. If the weighing station 166 determines the weight of the loaded box 158 falls outside the correct weight range, the human/machine interface 80 informs the operator to stop because something is wrong. The operator 18 informs the human/machine interface 8 at the beginning of the method which roll packed mattress and which box are to be used by inputting data at the human/machine interface 8.

If the operator 18 receives the "green light" or signal to proceed from the human/machine interface 8, the operator 18 either activates a button on the human/machine interface 8 or activates a foot pedal (not shown) to return the lift table 128 to its horizontal position.

Figure 19:
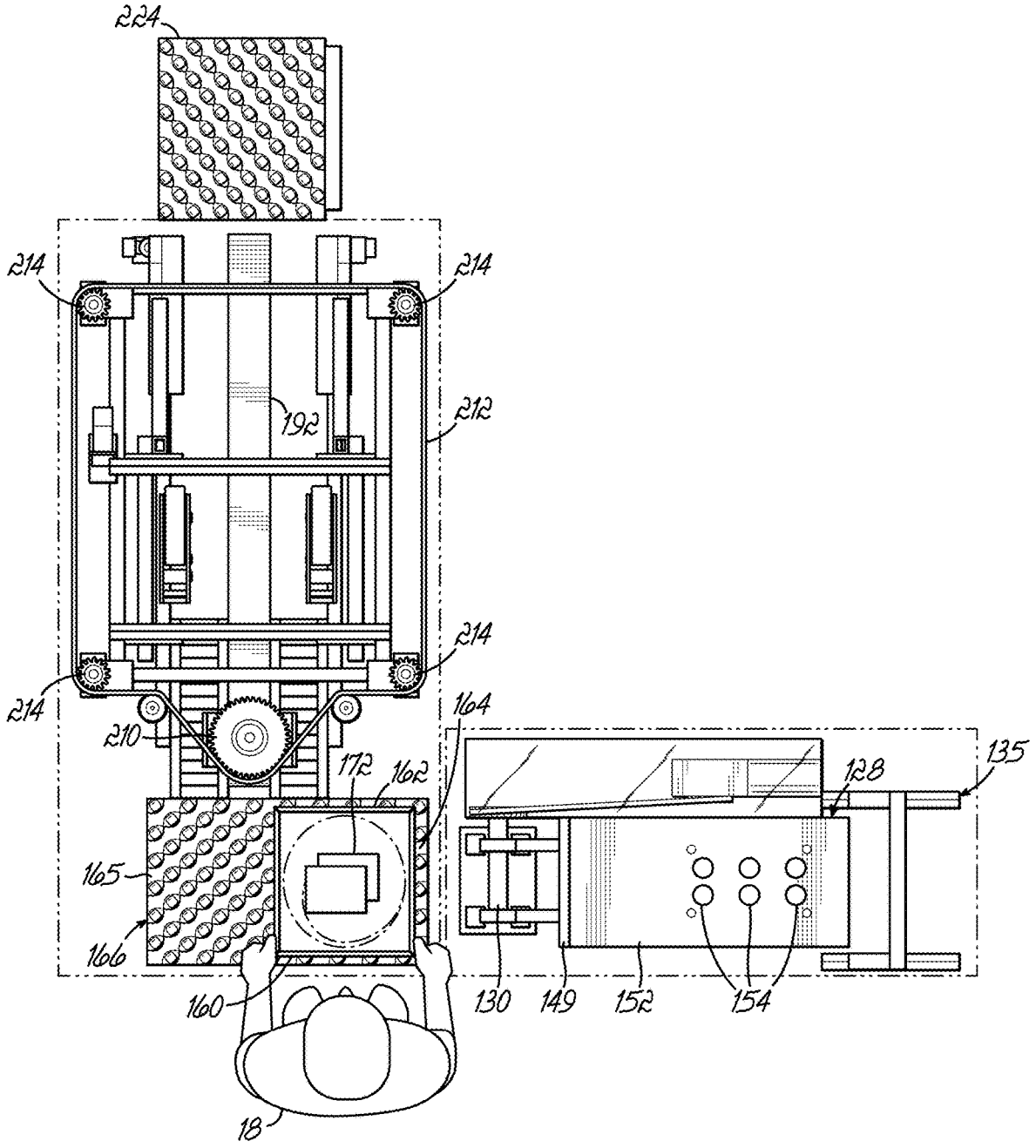
FIG. 19 is a top view of the second and third sections of the apparatus showing the loaded box being at the weighing station with literature therein.
Figure 20:
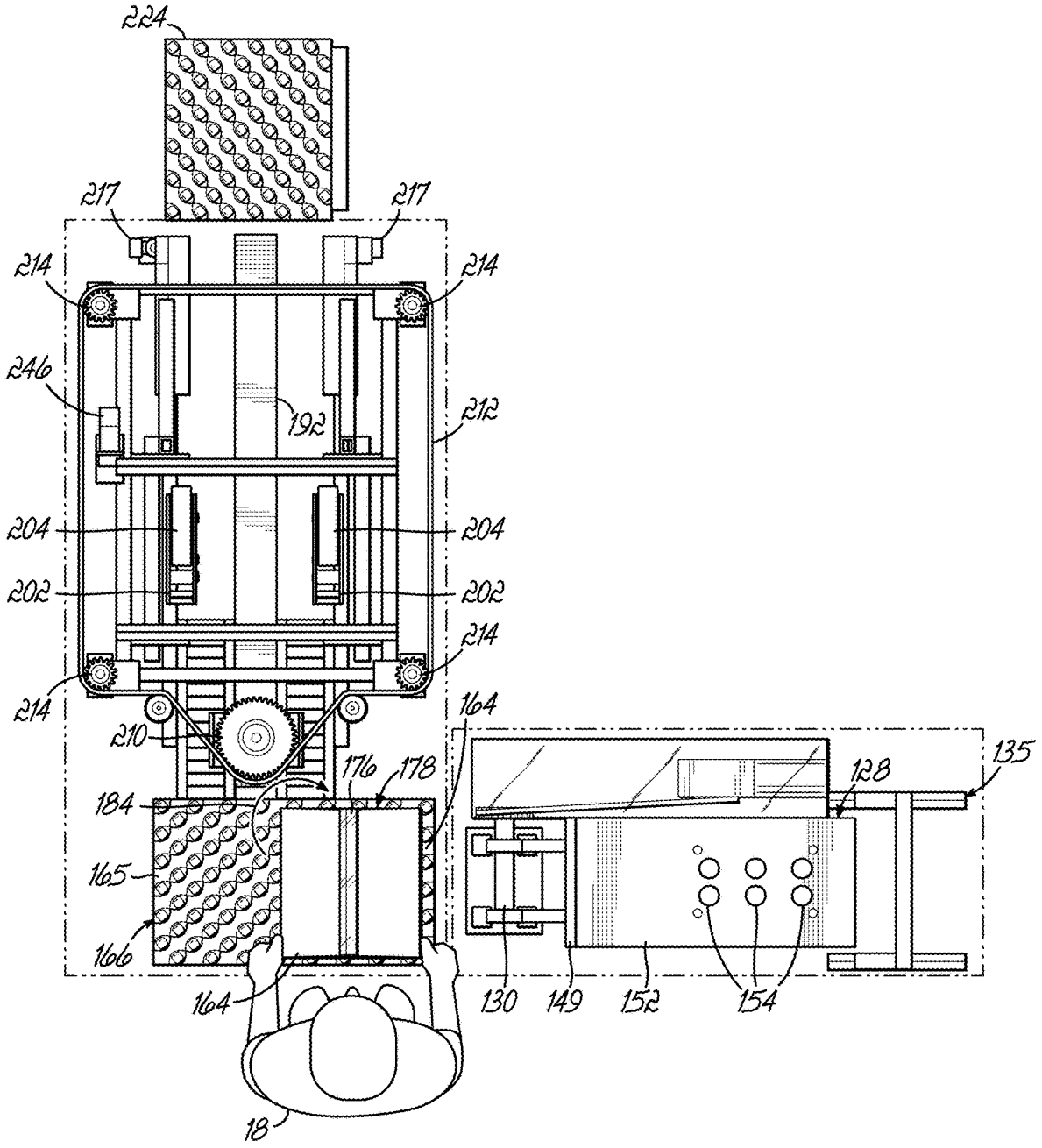
FIG. 20 is a top view of the second and third sections of the apparatus like FIG. 19 showing the operator having taped the upper end of the loaded box closed to create a loaded, closed box.

As best shown in FIGS. 17 and 18 the operator 18 stands on a catwalk 168 having a standing platform 170. Although one configuration of catwalk 168 is illustrated any other catwalk may be used; the drawings are not intended to be limiting. As shown in FIG. 18, in some instances, the operator 18 grabs literature 172 from a shelf 174 and puts it inside the interior 146 of the loaded box 158. The shelf 174 is attached to the catwalk 168. FIG. 19 shows the literature 172 inside the interior 146 of the loaded box 158. As shown in FIG. 19, the operator 18 then folds inwardly the front and rear flaps 160, 162. As shown in FIG. 20, the operator 18 then folds inwardly the side flaps 164 outside the front and rear flaps 160, 162 before manually placing a piece of tape 176 over portions of the side flaps 164 to create a closed box 178. The piece of tape 176 is on the top end 182 of the closed box 178, extends in the direction of travel of the closed box 178 and is parallel the strip of tape 122 on the bottom end 180 of the closed box 178 (which was the closed end 148 of the loaded box 158).

Figure 21:
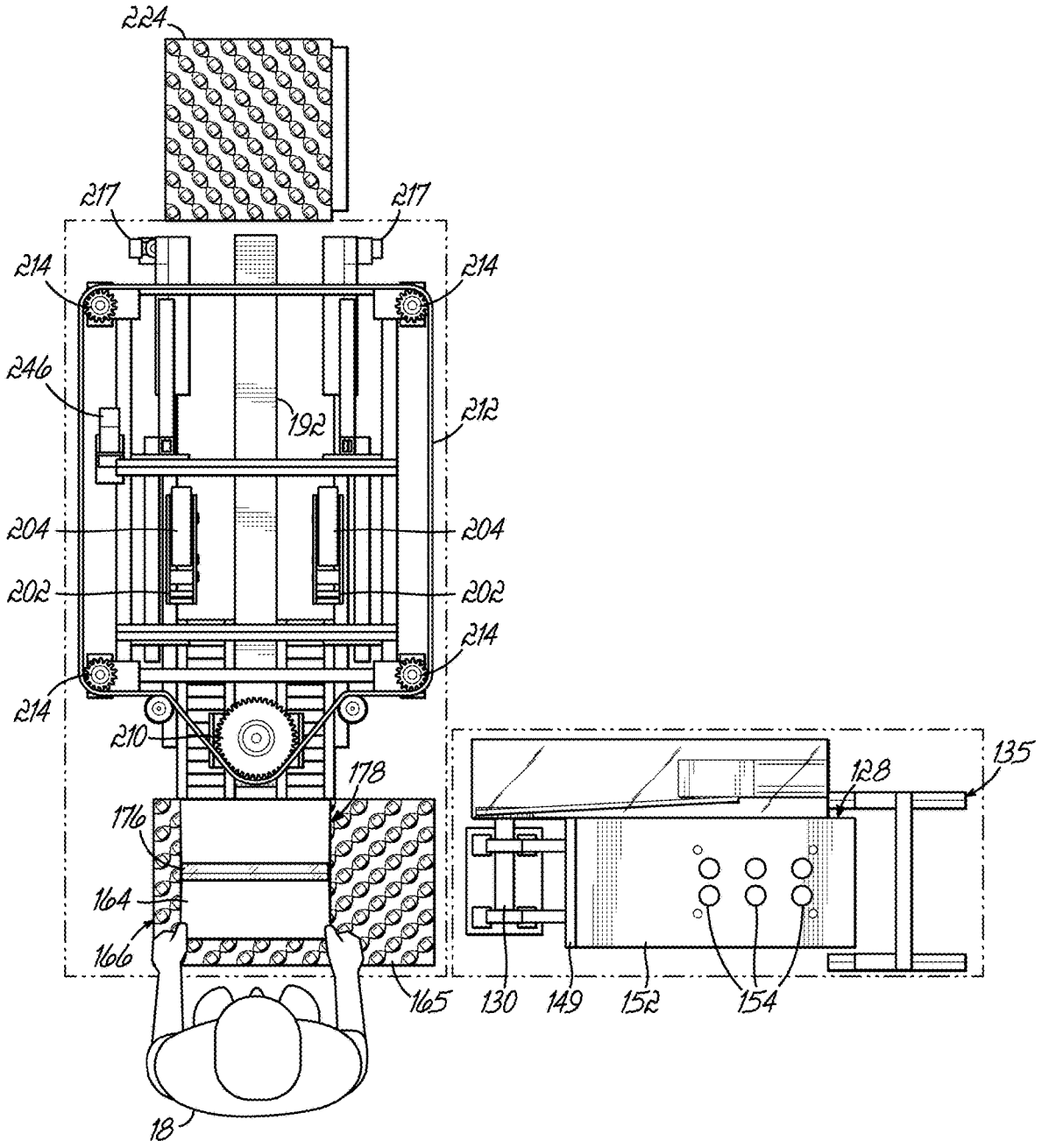
FIG. 21 is a top view of the second and third sections of the apparatus like FIG. 19 showing the operator having rotated the loaded, closed box and placing the loaded, closed box in a position to enter the third section of the apparatus.

After the closed box 178 is closed with the piece of tape 176, the operator 18 rotates the closed box 178 ninety degrees as shown by arrow 184. Although the arrow 184 shows the closed box 178 being rotated in a clockwise direction, it may be rotated in a counter-clockwise direction. Whichever direction the closed box 178 is rotated, the closed box 178 will be oriented as shown in FIG. 21, with the piece of tape 176 on the top end 182 being oriented perpendicular to the direction of travel of the closed box 178.

Figure 22:
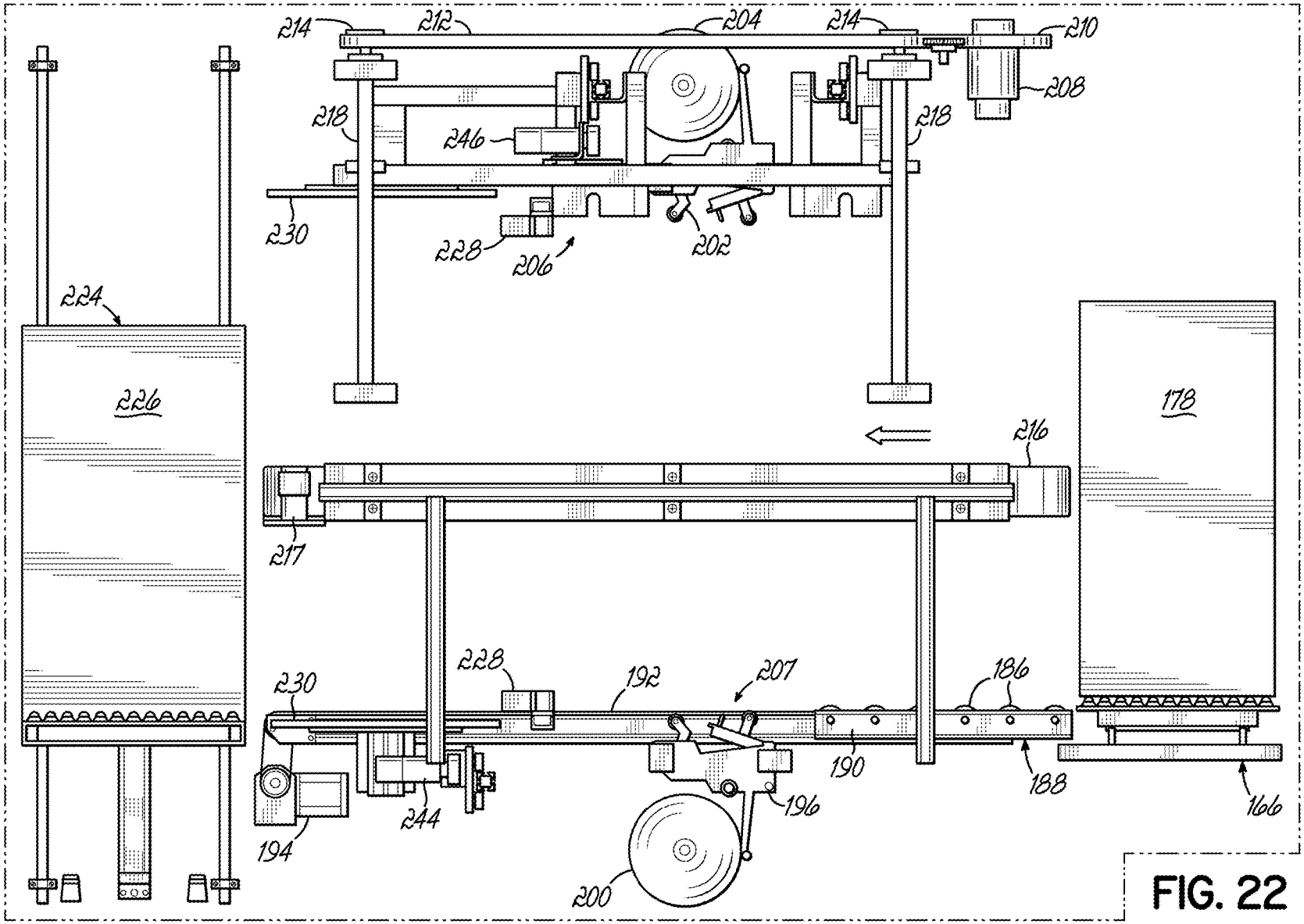
FIG. 22 is a side view of the third section of the apparatus showing the loaded, closed box on the weighing station about to enter the third section of the apparatus.

FIGS. 20-25 show the operation of the third section 26 of the apparatus 10. FIG. 22 shows the closed box 178 on the weighing station 166 before the operator 18 pushes the closed box 178 onto rollers 186 of roller assemblies 188 as best shown in FIG. 1. The roller assemblies 188 are spaced apart and generally coplanar like the roller assemblies 52 of the first section 22. The rollers 186 are supported by braces 190.

Figure 31:
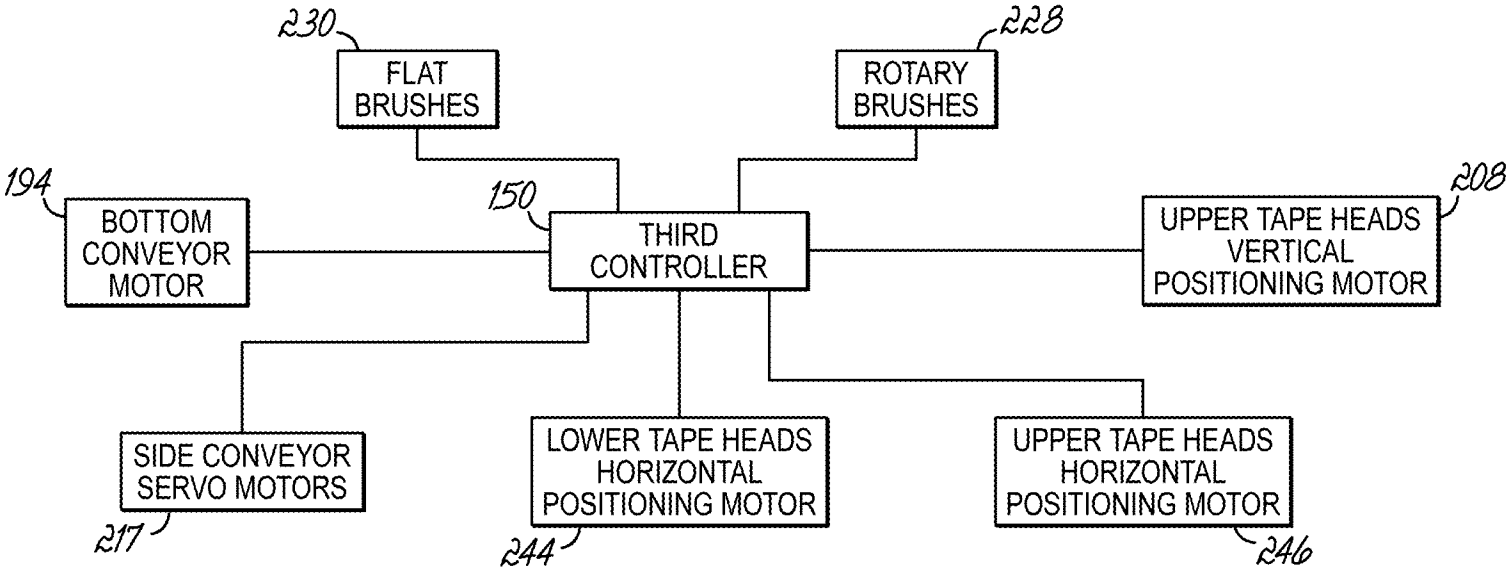
FIG. 31 is a flow chart further showing which parts of the third section of the apparatus are controlled by the third controller.

As best shown in FIGS. 1 and 22, a bottom conveyor belt 192 extends between the two roller assemblies 188 and is operated by a bottom conveyor motor 194. The bottom conveyor motor 194 is controlled by the third controller 150, as shown in FIG. 31. The bottom conveyor belt 192 is narrower than the closed box 178 which it transports downstream. The roller assemblies 188 provide additional support beside the bottom conveyor belt 188. The third section 26 of apparatus 10 further comprises side conveyors 216 which engage sides of the closed box 178. Each side conveyor 216 is driven by a side conveyor servo motor 217 as shown in FIGS. 20-25 and 27. See FIG. 31 also.

As shown in FIGS. 22-25, the third section 26 of apparatus 10 further comprises two bottom tape heads 196 (only one being shown) which are movable via operation of a lower servo motor 244 in the direction of arrow 198 shown in FIG. 1 (in the direction of the X axis). As shown in FIG. 31, the third controller 150 controls the operation of the lower servo motor 244. Each bottom tape head 196 holds a roll of tape 200 (only one being shown). The bottom tape heads 196 are laterally adjusted to fit the size of the closed box being taped.

As shown in FIGS. 20-25, the third section 26 of apparatus 10 further comprises an upper tape assembly 206 and a lower tape assembly 207. The upper tape assembly 206 moves vertically and horizontally. The lower tape assembly 207 only moves horizontally.

The upper tape assembly 206 comprises two top tape heads 202 which are movable via operation of an upper servo motor 246 in the direction of arrow 198 shown in FIG. 1 (in the direction of the Z axis) and movable in the vertical direction in the direction of the y axis. The third controller 150 controls the operation of the lower servo motor 244. Each top tape head 202 holds a roll of tape 204. The two top tape heads 202 are part of the upper tape assembly 206. The upper tape assembly 206 is movable between a raised position shown in FIGS. 22 and 25 and a lowered position shown in FIGS. 23 and 24 via operation of the vertical positioning servo motor 208 described below.

Figure 23:
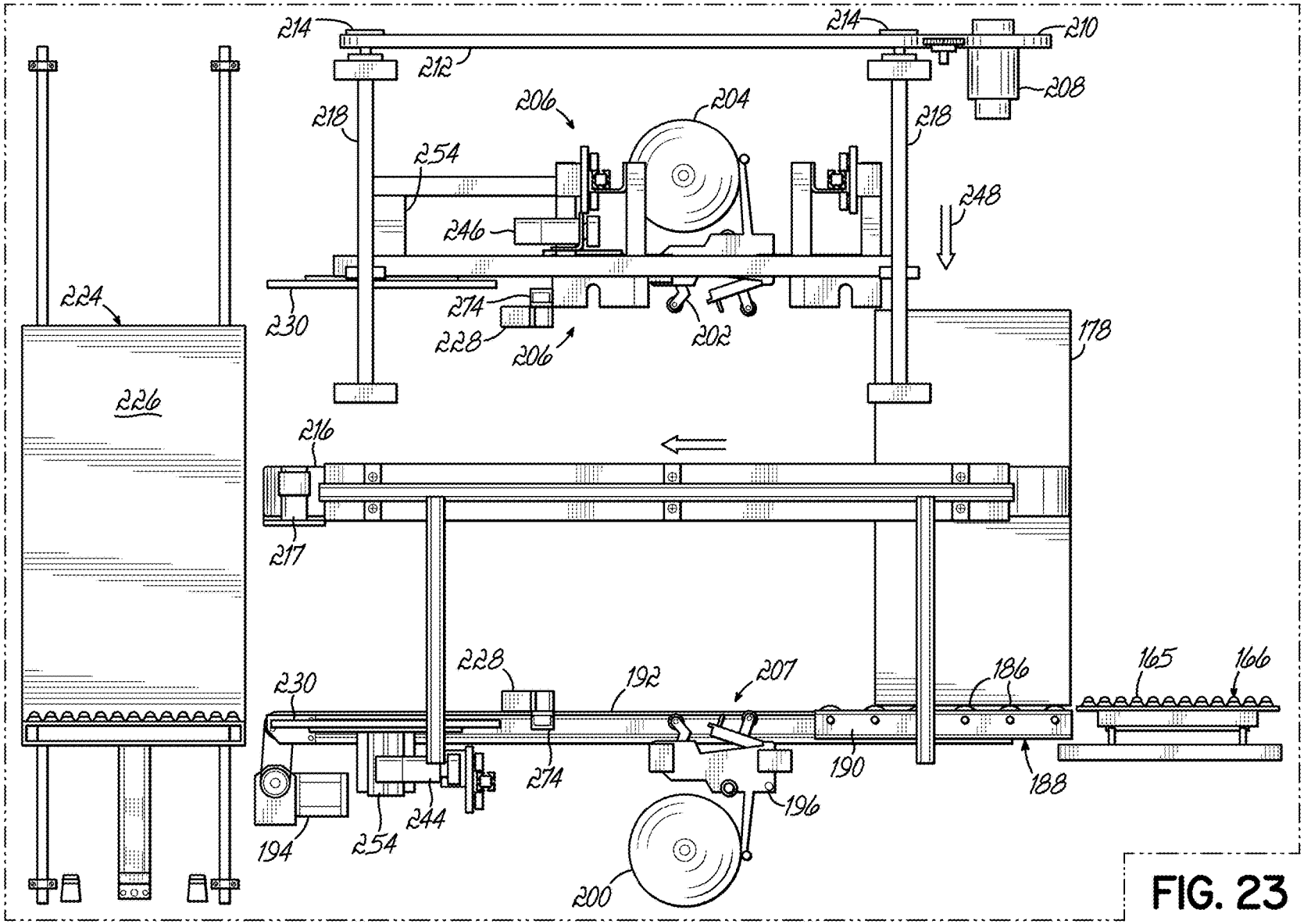
FIG. 23 is a side view of the third section of the apparatus showing the loaded, closed box being pulled through the third section of the apparatus and the top tape assembly being lowered.

As best shown in FIG. 20, the upper tape assembly 206 further comprises vertical positioning servo motor 208 which drives a drive gear 210. Operation of the vertical positioning servo motor 208 is controlled by the third controller 150. See FIG. 31. An endless drive belt or chain 212 surrounds the drive gear 210 and rotates four sprockets 214. Each of the sprockets 214 is welded or secured to a drive screw 218 at the upper end of the drive screw 218. Rotation of the drive screws 218 via rotation of the sprockets 214 causes vertical movement of the upper tape assembly 206 between its raised and lowered positions. FIG. 22 shows the upper tape assembly 206 in its raised position while FIG. 23 shows the upper tape assembly 206 being lowered into its lowered position. The upper tape assembly 206 has two tape heads 202.

The top and bottom tape heads 202, 196, respectively, are moved into position by third controller 150 according to the product selected by the operator 18. Tape is applied to a front surface, along the top/bottom surfaces and to the back surface of the closed box 178. While the closed box 178 is traveling between the tape heads, a sensor might be tripped on the front edge of the closed box 178 indicating that one of the side wipers 228 needs to engage with the front exposed flap of tape. As indicated in FIG. 31, the side wipers 228 are rotary brushes and the vertical wipers 230 are flat brushes.

FIG. 22 illustrates the closed box 178 on the platform 165 at the weighing station 166. FIG. 23 illustrates the closed box 178 being moved downstream via the bottom conveyor 192 and side conveyors 216 prior to the closed box 178 engaging the tape heads. Initial movement of the closed box 178 into engagement with the bottom conveyor 192 and side conveyors 216 is accomplished by a push from the operator 18. FIG. 23 further illustrates the upper tape assembly 206 being lowered from its raised position towards its lowered position as shown by arrow 248 in FIG. 23 via rotation of the sprockets 214 caused by rotation of the drive gear 210.

Figure 24:
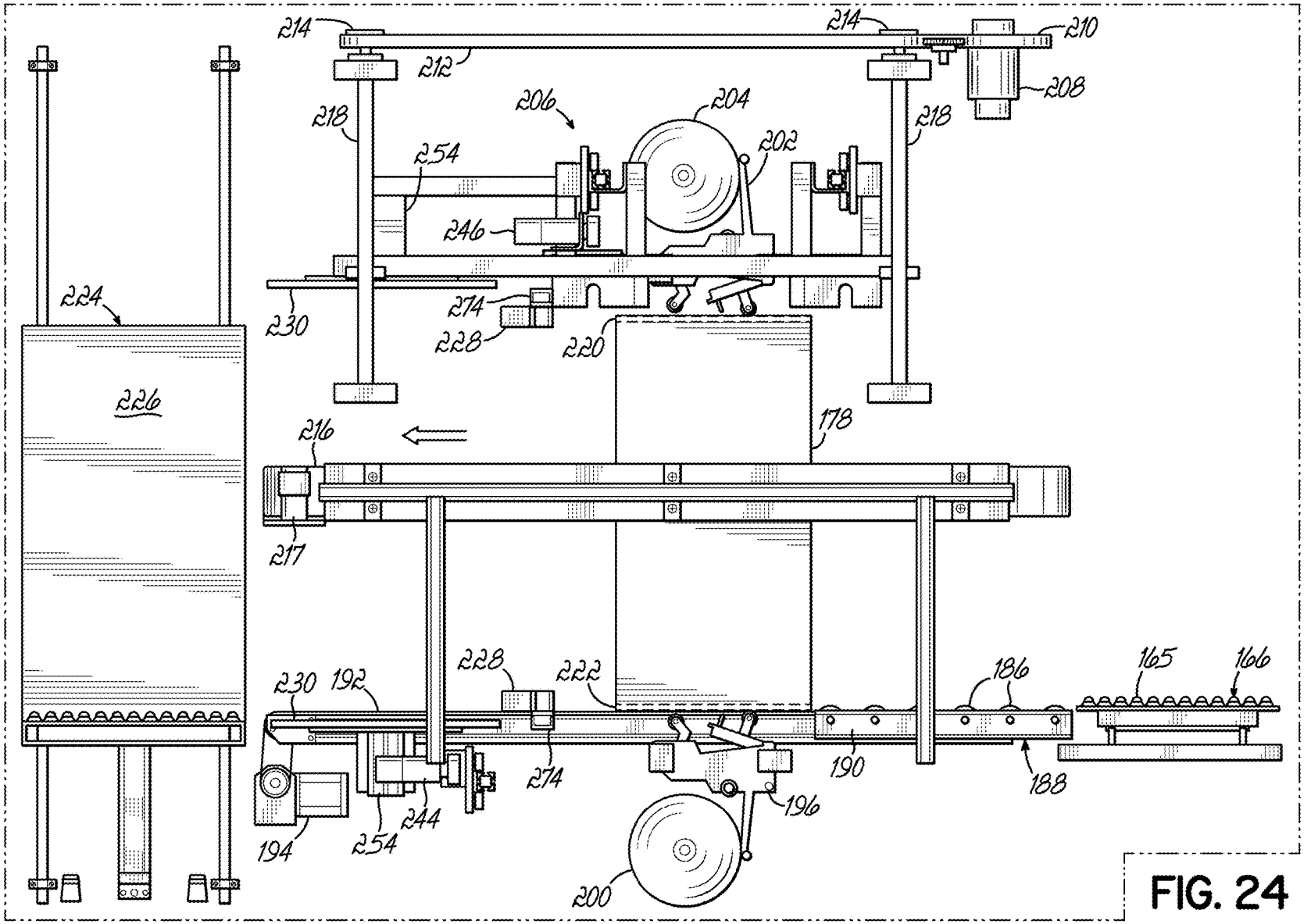
FIG. 24 is a side view of the third section of the apparatus showing the loaded, closed box being taped with the top and bottom tape heads.

FIG. 24 illustrates the top tape heads 202 of the upper tape assembly 206 applying upper tape pieces 220 along the upper edges of the closed box 178. The upper tape assembly 206 is in its lowered position. Secondly, FIG. 24 illustrates the bottom tape heads 196 applying lower tape pieces 222 along lower edges of the closed box 178.

After the closed box 178 exits the top and bottom tape heads 202, 196, the tape heads cut the tape and roll the tape down a back surface of the closed box 178. The back edge of the tape is still hanging over the edge of the closed box and must be laid down the side of the closed box 178. The front side wipers 228 engage the front tape vertical sections 250. The front side wipers 228 then rotating back 90 degrees from their original start position to fold the tape along rear vertical sections 252 on the back side of the closed box 178. The box then stops at the next sensor to operate the vertical wipers 230. The vertical wipers 230 (top and bottom) are activated to lay the tape hanging over the edge of the top/bottom of the box down and up the sides of the box.

FIG. 25 illustrates the fully taped, finished box 30 on an offloading table 224. The offloading table 224 has a back 226 to support the fully taped, finished box 30 and prevent it from falling. The offloading table 224 may be stationary or movable. If movable, the operator may activate a switch to raise/lower the offloading table 224. Alternatively, the offloading table 224 may be manually moved or moved in any known manner.

FIG. 27 illustrates a flow chart showing the operation of the first section 22 of the apparatus 10. As indicated in FIG. 27, the human/machine interface 8 is connected to the first controller 50 which operates the first section 22 of the apparatus 10.

As indicated in box 275 of FIG. 27, the tape actuator 360 raises the tape assembly 112 from its lowered position to its taping position. As indicated in box 276 of FIG. 27, from its home position the picker actuator 28 lowers the picker plate 32 of the picker actuator 28 until the picker suction cups 34 contact a flattened box 20. The first controller 50 then turns on or activates the picker suction cups 34, as indicated in box 278. The picker plate 32 of picker actuator 28 is then raised with the flattened box 20 secured to the picker suction cups 34. See box 280 of FIG. 27. As indicated in box 282 of FIG. 27, the picker servo motor 47 is then started or activated by the first controller 50. The picker servo motor 47 moves the picker actuator 28 downstream to the transfer location shown in FIG. 4 by moving the picker belt 45. See box 284 of FIG. 27. As shown in box 286 of FIG. 27, the picker servo motor 47 is stopped by the first controller 50 when the picker actuator 28 is at the transfer location. As shown in box 288 of FIG. 27, the picker actuator 28 then lowers the picker plate 32 with the flattened box 20 attached to a lowered position. As shown in box 290 of FIG. 27, the first controller 50 then activates the transport suction cups 76 of the transport actuator 44. As shown in box 292 of FIG. 27, the first controller 50 turns off the picker suction cups 34 of the picker actuator 28. As shown in box 294 of FIG. 27, the first controller 50 then raises the picker plate 32 with a box attached thereto. As shown in box 296 of FIG. 27, the first controller 50 starts the picker servo motor 47. The picker servo motor 47 moves the picker actuator 28 back to its home position. See box 298 of FIG. 27.

Further shown in box 300 of FIG. 27, the first controller 50 starts the erector servo motor 80. As shown in box 302 of FIG. 27, rotation of the erector belt 86 by the erector servo motor 80 moves the erector actuator 56 to the erecting location. FIGS. 6 and 7 show the erector actuator 56 in the erecting position/location. When the erector actuator 56 is at the erecting location, the erector servo motor 80 stops as indicated in box 303. Furthermore, the erector actuator 56 lowers the erector plate 60. See box 304. The first controller 50 activates the erector suction cups 62 to grab an upper surface of the flattened box 20. See box 305. After the erector suction cups 62 have hold of the flattened box 20, the erector actuator 56 raises the erector plate 60 as shown in box 306 to lift a portion of the box. Simultaneously, as shown in box 308, the erector servo motor 80 further activates or starts, moving the erector actuator 56 upstream.

The combined lifting and upstream movement of the top of the box 20 erects the box. At the proper location determined by the first controller 50, the erector servo motor 80 stops, as indicated in box 310 of FIG. 27.

The erected box 25 at this point has both ends open so one can see through the erected box. As indicated in box 312, the front vertical flap closer 96 extends to close the first vertical flap 102. As indicated in box 314, the rear vertical flap closer 106 then extends to close the close the second or downstream vertical flap 104.

As indicated in box 316, the erector servo motor 80 starts and as indicated in box 318, the transport servo motor 264 starts to move the partially closed box 21 further downstream. As indicated in box 320, the horizontal flaps actuator 226 fires out to close the horizontal flaps outside the vertical flaps. At this point, the front flap closer 96 retracts, as shown in box 322. As shown in box 324, the tape assembly 112 applies tape to close the end of the box.

As shown in box 326, the horizontal flaps actuator 226 retracts to its resting position. As shown in box 328, the transport servo motor 264 stops. The erector servo motor 80 stops too, as shown in box 330. As shown in box 332, the two transport suction cups 76 secured to the transport plate 75 turn off.

As shown in box 334, the erector actuator 56 raises the erector plate 60 to its raised position shown in FIG. 8. As shown in box 336, the erector servo motor 80 starts to move the erector actuator 56 upstream using the erector belt 86. As shown in box 338, the erector servo motor 80 stops, thereby stopping movement of the erector belt 86. As shown in box 340, the transport servo motor 264 starts and returns the transport actuator 44 to its home position, as indicated in box 342.

With the erector actuator 56 engaged with the partially closed box 21 above its loading position, the erector actuator 56 is lowered until the partially closed box 21 rests on the lift table 128, as shown in FIG. 15. Box 344 of FIG. 27 indicates this step of lowering the erector actuator 56 and partially closed box 21. As indicated in box 346, when the partially closed box 21 is supported by the lift table 128, the erector suction cups 62 of the erector actuator 56 are turned off. The erector actuator 56 is then raised, as indicated in box 348. The erector servo motor 80 is then started, as indicated in box 350 and the erector actuator 56 returned to its home position, as indicated by box 352.

FIG. 28 is a flow chart showing an overview of the controllers 50, 100, 150. The human/machine interface 8 provides input to the weighing station 166 of the second section 24. The human/machine interface 8 further provides input to the first controller 50, the second controller 100 and the third controller 150.

FIG. 29 is a flow chart showing an overview of the first controller 50. The first controller 50 controls operation of the picker actuator 28, the picker suction cups 34 and the picker servo motor 47. The first controller 50 further controls operation of the erector actuator 56, the erector suction cups 62 and the erector servo motor 80. The first controller 50 further controls operation of the transport actuator 44, the transport suction cups 76 and the transport servo motor 264. The first controller 50 further controls operation of the front and rear vertical flap closers 96, 106, respectively.

FIG. 30 is a flow chart showing an overview of the second controller 100. The second controller 100 controls operation of the lift motor 234, the lift table suction cups 156 and the entrance frame position actuator 256.

FIG. 31 is a flow chart showing an overview of the third controller 150. The third controller 150 controls operation of the bottom conveyor motor 194, the side conveyor servo motors 217, lower servo motor 244, upper servo motor 246, vertical positioning servo motor 208, flat brushes and rotary brushes.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, more than five layers may be laminated together. The invention in its broader aspects is, therefore, not limited to the specific details, representative apparatus and method, and illustrative examples shown and described. Accordingly, departures may be made from such details without departing from the spirit or scope of the general inventive concept.

What is claimed is:

1. An apparatus for boxing a roll packed mattress for shipment, said apparatus comprising:

a first section comprising a movable picker actuator having a picker plate with suction cups to transport a flattened box to a transfer location;

a movable transport actuator comprising a transport plate with suction cups for gripping a bottom surface of the flattened box at the transfer location, the transport actuator being movable underneath the flattened box;

an erector actuator comprising an erector plate and suction cups for gripping a top surface of the flattened box adjacent to the picker plate above the flattened box;

wherein the first section further comprises a first controller for disengaging the picker actuator from the flattened box and returning the picker actuator to its home position, raising the erector plate of the erector actuator while the transport actuator remains stationary to erect the flattened box into an erected box, folding and taping box flaps of the erected box to create a partially closed box, disengaging the transport actuator from the partially closed box and returning the transport actuator to its home position and moving the partially closed box to a mattress loading station;

a second section of the apparatus comprising the mattress loading station for inserting a roll packed mattress into the partially closed box to create a loaded box having an open end, a lift table to lift the loaded box to a standing position and a second controller for controlling a lift mechanism; and a third section of the apparatus comprising an upper tape assembly and a lower tape assembly controlled by a third controller for converting a closed box into a finished box.

2. The apparatus of claim 1, wherein the third section of the apparatus further comprises conveyors.

3. The apparatus of claim 1, wherein the first controller controls activation of the picker actuator, the transport actuator and the erector actuator.

4. The apparatus of claim 1, further comprising a human/machine interface at which an operator manually inputs the size of the box and the weight of the roll packed mattress.

5. The apparatus of claim 1, wherein the second section of the apparatus comprises a catwalk for an operator.

6. The apparatus of claim 1, wherein the first controller further controls the activation of the suction cups.

7. The apparatus of claim 1, wherein the second section of the apparatus further comprises an entrance frame positioning actuator.

8. An apparatus for boxing a roll packed mattress for shipment, said apparatus comprising:

a first section comprising a movable picker actuator having a picker plate with suction cups to transport a flattened box to a transfer location;

a movable transport actuator comprising a transport plate with suction cups for gripping a bottom surface of the flattened box at the transfer location, the transport actuator being movable underneath the flattened box;

an erector actuator comprising an erector plate and suction cups for gripping a top surface of the flattened box adjacent to the picker plate above the flattened box;

wherein the first section further comprises a first controller for disengaging the picker actuator from the flattened box and returning the picker actuator to its home position, raising the erector plate of the erector actuator while the transport actuator remains stationary to erect the flattened box into an erected box, folding closed vertical box flaps of the erected box, folding top and bottom flaps of the erected box outside the closed vertical box flaps to create a partially closed, untaped, erected box, moving the partially closed, untaped, erected box downstream past a tape dispenser to tape the top and bottom flaps of the untaped, erected box together to create a partially closed box, disengaging the transport actuator from the partially closed box and returning the transport actuator to its home position and moving the partially closed box to a mattress loading station;

a second section of the apparatus comprising the mattress loading station for inserting a roll packed mattress into the partially closed box to create a loaded box having an open end, a lift table to lift the loaded box to a standing position and a second controller for controlling a lift mechanism including the lift table;

a third section of the apparatus comprising an upper tape assembly and a lower tape assembly controlled by a third controller for converting a closed box into a finished box.

9. The apparatus of claim 8, wherein the picker actuator moves the picker plate vertically and horizontally.

10. The apparatus of claim 8, wherein the second section of the apparatus further comprises an entrance frame positioning actuator.

11. The apparatus of claim 8, wherein first section of the apparatus further comprises at least one flap closer activated by the first controller.

12. The apparatus of claim 8, wherein the first section of the apparatus moves the erected box downstream past stationary arms using the erector and transport actuators simultaneously.

13. The apparatus of claim 8, wherein the third section of the apparatus further comprises conveyors to transfer the finished box to the offloading table.

14. The apparatus of claim 8, wherein the upper and lower tape assemblies tape outer edges of the closed box at each end of the closed box to create the finished box.

15. An apparatus for boxing a roll packed mattress for shipment, said apparatus comprising:

a first section comprising a movable picker actuator having a picker plate with suction cups to transport a flattened box to a transfer location;

a movable transport actuator comprising a transport plate with suction cups for gripping a bottom surface of the flattened box at the transfer location;

an erector actuator comprising an erector plate and suction cups for gripping a top surface of the flattened box adjacent to the picker plate above the flattened box;

wherein the first section further comprises a first controller for disengaging the picker actuator from the flattened box and returning the picker actuator to its home position, raising the erector plate of the erector actuator while the transport actuator remains stationary to erect the flattened box into an erected box, the first section further comprising an apparatus for folding and taping box flaps of the erected box to create a partially closed box;

a second section of the apparatus comprising a mattress loading station for inserting a roll packed mattress into the partially closed box to create a loaded box having an open end, a lift table to lift the loaded box to a standing position and a second controller for controlling a lift mechanism; and a third section of the apparatus comprising an upper tape assembly and a lower tape assembly controlled by a third controller for converting a closed box into a finished box.

16. The apparatus of claim 15, wherein the picker actuator moves the picker plate vertically and horizontally.

17. The apparatus of claim 15, wherein the transport actuator is movable underneath the flattened box.

18. The apparatus of claim 15, wherein the first controller further functions to fold closed vertical box flaps of the erected box, fold top and bottom flaps of the erected box outside the closed vertical box flaps to create a partially closed, untaped, erected box, moving the partially closed, untaped, erected box downstream past a tape dispenser to tape the top and bottom flaps of the untaped, erected box together to create a partially closed box, disengaging the transport actuator from the partially closed box and returning the transport actuator to its home position and moving the partially closed box to a mattress loading station.

19. The apparatus of claim 18, wherein the first controller activates at least one flap closer.

20. The apparatus of claim 15, wherein the third section comprises conveyors.

* * * * *